US009341997B2

(12) United States Patent
Mitsuoka

(10) Patent No.: US 9,341,997 B2
(45) Date of Patent: May 17, 2016

(54) LASER FIXING DEVICE AND IMAGE FORMING APPARATUS

(75) Inventor: Tetsunori Mitsuoka, Osaka (JP)

(73) Assignee: SHARP KABUSHIKI KAISHA, Osaka-shi, Osaka (JP)

( * ) Notice: Subject to any disclaimer, the term of this patent is extended or adjusted under 35 U.S.C. 154(b) by 768 days.

(21) Appl. No.: 12/916,863

(22) Filed: Nov. 1, 2010

(65) Prior Publication Data

US 2011/0103816 A1 May 5, 2011

(30) Foreign Application Priority Data

Nov. 4, 2009 (JP) ..... 2009-252684

(51) Int. Cl.
*G03G 15/20* (2006.01)

(52) U.S. Cl.
CPC ..... *G03G 15/201* (2013.01); *G03G 15/2007* (2013.01)

(58) Field of Classification Search
CPC ..... G03G 15/2007; G03G 15/201
USPC ..... 399/67, 336
See application file for complete search history.

(56) References Cited

U.S. PATENT DOCUMENTS

2008/0101832 A1* 5/2008 Yaoi et al. ..... 399/336

FOREIGN PATENT DOCUMENTS

| | | |
|---|---|---|
| JP | 59-152472 | 8/1984 |
| JP | 07-191560 | 7/1995 |
| JP | 11-038802 | 2/1999 |
| JP | 2005-055516 | 3/2005 |
| JP | 2005-106974 | 4/2005 |
| JP | 2005-173339 | 6/2005 |
| JP | 2006-119567 | 5/2006 |
| JP | 2008-107576 | 5/2008 |

* cited by examiner

*Primary Examiner* — Joseph S Wong

(74) *Attorney, Agent, or Firm* — Nixon & Vanderhye, P.C.

(57) ABSTRACT

A fixing device includes: a plurality of laser irradiation sections each of which emits a laser beam whose wavelength exhibits an absorbance of 80% or more with respect to a corresponding toner; and a control device for controlling the plurality of irradiation sections so that in order to fuse a black toner, (i) a laser irradiation section corresponding to the black toner among the plurality of laser irradiation sections irradiates the black toner with a laser beam thereof, and (ii) the other laser irradiation sections irradiate the black toner with laser beams thereof, where the other laser irradiation sections do not correspond to the black toner among the plurality of laser irradiation sections. Therefore, it is possible to provide a laser fixing device which can fix a color toner while preventing an increase in size of the fixing device as much as possible.

11 Claims, 11 Drawing Sheets

LASER FIXING DEVICE AND IMAGE FORMING APPARATUS

This Nonprovisional application claims priority under 35 U.S.C. §119(a) on Patent Application No. 2009-252684 filed in Japan on Nov. 4, 2009, the entire contents of which are hereby incorporated by reference.

TECHNICAL FIELD

The present invention relates to a fixing device for fixing a toner image on a sheet, which toner image has been transferred to the sheet. Specifically, the fixing device fuses the toner image by irradiating the toner image with a laser beam so that the toner image is fixed on the sheet.

BACKGROUND ART

An electrophotographic image forming apparatus (a printer, for example) includes a fixing device for fixing a toner image on a sheet, which toner image has been formed on the sheet. The fixing device fuses the toner image so that the toner image is fixed on the sheet. One example of such a fixing device may be a fixing device employing a pair of rollers, i.e. a fixing roller and a pressure roller (see Patent Literature 1).

The fixing roller is such a roller member that an elastic layer is formed on a surface of a hollow cored bar made of a metal (such as aluminum). In the cored bar, a halogen lamp is provided as a heat source. On the basis of a signal supplied from a temperature sensor provided on a surface of the fixing roller, a temperature control device controls the halogen lamp to be turned on/off so that a temperature of the surface of the fixing roller is controlled.

The pressure roller is such a roller member that a heat resistance elastic layer (such as silicon rubber) is provided on a cored bar, as a coating layer. The pressure roller is pressed against the surface of the fixing roller, so that a nip region is formed between the fixing roller and the pressure roller due to elastic deformation of the elastic layer of the pressure roller.

The fixing device having such an arrangement receives the sheet on which a toner image has been formed but not fixed yet. The fixing device pressures the sheet in the nip region between the fixing roller and the pressure roller, while carrying the sheet by rotation of these rollers. The toner image on the sheet is fused by heat generated from the surface of the fixing roller. Thereby, the toner image is fixed on the sheet.

The conventional fixing device employing such a pair of rollers, however, has the following problems. When the fixing device is turned on, the temperatures of the fixing roller and the pressure roller are equal to a room temperature. Therefore, it is necessary for the fixing device to secure a warm-up period of time for warming these rollers up to a predetermined temperature. Further, even in a standby state in which the image forming apparatus is carrying out no copy operation, it is necessary to keep the surface of each of the rollers being at the predetermined temperature. In other words, it is necessary to keep on heating the surface of each of the rollers even in the standby state, i.e. even during a period of time in which no copy operation is being carried out. This wastes energy.

In view of the problems, there has been proposed a fixing device for fixing a toner by use of power of a laser beam (see Patent Literature 2), as a technique for efficiently fixing only a toner on the sheet without unnecessarily wasting energy.

According to Patent Literature 2, a fixing device employs a light source including a plurality of low-power semiconductor lasers. The fixing device irradiates a toner image located in a certain region on the sheet with a plurality of laser beams by use of the light source so that the plurality of laser beams overlap each other on the toner image. This compensates a shortage of power to fuse the toner so that the toner is fixed on the sheet.

Patent Literature 2 describes that the technique allows the use of a low-power and low-price semiconductor laser and therefore allows simplification of an arrangement of the fixing device.

Further, Patent Literature 3 discloses an image forming apparatus which can fix a toner image on a sheet by irradiating the toner image with such laser beams whose wavelengths correspond to light-absorption wavelengths of full color toners (Y, M, C) and a black toner (B), respectively. According to the technique, (i) a laser used for each of the toners has an optimum wavelength in terms of the light-absorption wavelength of that toner, and the laser is controlled to irradiate only that toner with its laser beam. With this technique, in a case where four lasers whose wavelengths correspond to the respective toners are merely provided, there arise problems of an increase in cost and an increase in size of the fixing device (see Patent Literature 3).

CITATION LIST

[Patent Literature 1]

Japanese Patent Application Publication, Tokukaihei, No. 11-038802 A (Publication Date: Feb. 12, 1992)

[Patent Literature 2]

Japanese Patent Application Publication, Tokukai, No. 2005-55516 A (Publication Date: Mar. 3, 2005)

[Patent Literature 3]

Japanese Patent Application Publication, Tokukai, No. 2008-107576 A (Publication Date: May 8, 2008)

SUMMARY OF INVENTION

Technical Problem

The technique disclosed in Patent Literature 2, however, has a problem in fixing a color toner. Even if the shortage of power is compensated by use of a plurality of low-power semiconductor lasers, a toner that absorbs only a particular absorption wavelength, such as a color toner, is not heated at all due to a fact that the wavelength of the laser beam and the absorption wavelength of the toner are different from each other. Accordingly, such a toner cannot be efficiently fixed. Color toners (generally, C, M, and Y) have different absorption wavelengths, respectively. For this reason, it is difficult to heat a color toner with a specific wavelength, e.g. a wavelength of a semiconductor laser. Further, adjustment of an absorption wavelength of a color toner to a wavelength of a laser beam requires an addition of a light absorbing material to the color toner. This addition of the light absorbing material may cause a decrease in brightness of the color toner, and/or an increase in cost.

Moreover, the technique disclosed in Patent Literature 3 requires the provision of four lasers which have different wavelengths, respectively, which four lasers irradiate corresponding four toners of different colors with their laser beams, respectively. With this technique, for an image formed by use of one toner, only one laser is used to fix the toner. Consequently, in order to fix the toner by use of the laser only, it is necessary to set a maximum output of the laser to be high. This causes an increase in cost and an increase in size of the fixing device.

The present invention is made in view of the problems. An object of the present invention is to provide a laser fixing device which can fix a color toner while preventing an increase in size of the fixing device as much as possible.

Solution to Problem

In order to attain the object, a laser fixing device of the present invention, for use in an electrophotographic image forming apparatus for forming an image on a sheet by use of a plurality of toners of different colors, the laser fixing device fusing a toner adhering to the sheet among the plurality of toners by irradiating the toner with a laser beam so as to fix the toner on the sheet, includes: a plurality of laser irradiation sections for outputting laser beams of different wavelengths, respectively, wherein each of the plurality of toners corresponds to one of the plurality of laser irradiation sections, and each of the plurality of laser irradiation sections outputs a laser beam whose wavelength exhibits an absorbance of 80% or more with respect to a corresponding one of the plurality of toners; and a control section for controlling the plurality of laser irradiation sections so that in order to fuse at least one of the plurality of toners, a laser irradiation section, corresponding to the at least one of the plurality of toners among the plurality of laser irradiation sections, irradiates the at least one of the plurality of toners with a laser beam thereof, and (ii) at least one of the other laser irradiation sections among the plurality of laser irradiation sections also irradiates the at least one of the plurality of toners with a laser beam thereof.

Advantageous Effects of Invention

According to the present invention, it is possible to provide a laser fixing device which can fix a color toner while preventing an increase in size of the laser fixing device as much as possible.

DESCRIPTION OF EMBODIMENTS

[Configuration of Image Forming Apparatus]

Figure 1:
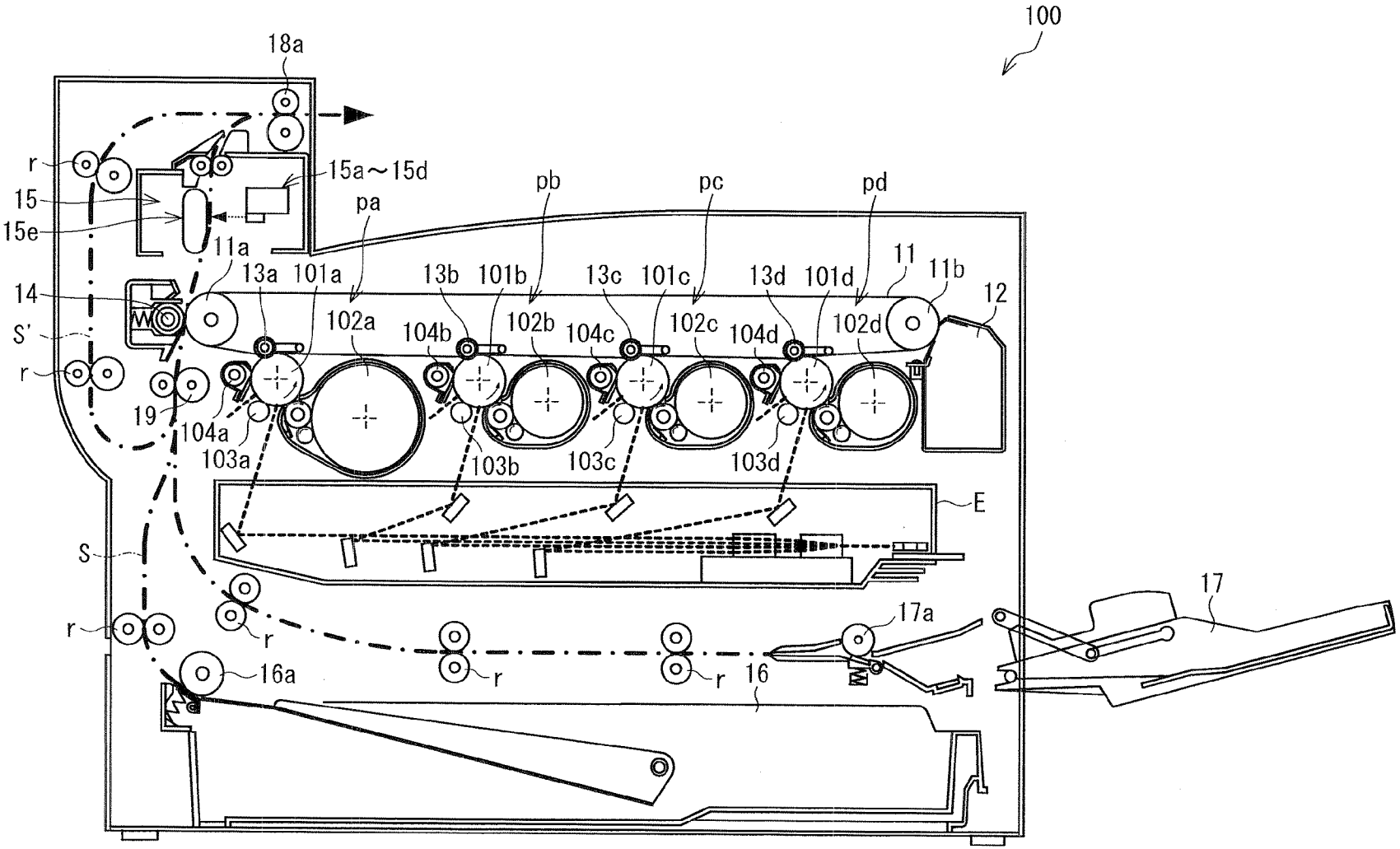
FIG. 1 is a view schematically illustrating a configuration of an entire image forming apparatus including a fixing device in accordance with one embodiment of the present invention.

One embodiment of the present invention is described below with reference to drawings. FIG. 1 is a view schematically illustrating a configuration of an entire image forming apparatus including a fixing device of the present embodiment.

An image forming apparatus 100 is a dry electrophotographic printer. The image forming apparatus 100 forms a multicolor or single color image on a prescribed sheet (recording paper) on the basis of image data transmitted from a terminal device via a network, or the like. Note that the image forming apparatus 100 may be a multifunction printer, or a printer included in a copying machine.

The image forming apparatus 100 includes: an optical system unit E; visible image forming units pa, pb, pc, and pd; an intermediate transfer belt 11; a second transfer unit 14; a fixing device (fixing unit) 15; an internal paper feeding unit 16; and a manual paper feeding unit 17 (see FIG. 1).

As illustrated in FIG. 1, the visible image forming units pa, pb, pc, and pd have photoreceptor drums 101*a*, 101*b*, 101*c*, and 101*d*, respectively.

The optical system unit E is designed to expose the photoreceptor drums 101*a*, 101*b*, 101*c*, and 101*d* of the respective four visible image forming units pa, pb, pc, and pd to light emitted from a laser light source. More specifically, the optical system unit E is constituted by: the laser light source for emitting laser light in response to image data which has been read out from a memory or transmitted from an external device; a polygon mirror for polarizing the laser light; an f-θ lens for correcting the polarized laser beam; and so on. The optical system unit E exposes charged photoreceptor drums 101*a*, 101*b*, 101*c*, and 101*d* in accordance with input image data, so as to form an electrostatic latent image on each of surfaces of the photoreceptor drums 101*a*, 101*b*, 101*c*, and 101*d*.

In addition to the photoreceptor drum 101*a*, the visible image forming unit pa includes: a developing unit 102*a*; a charging unit 103*a*; a cleaning unit 104*a*; and a first transfer unit 13*a*, each of which is provided in the vicinity of the photoreceptor 101*a*. The developing unit 102*a* has a black (B) toner inside thereof.

The charging unit 103*a* charges a surface of the photoreceptor drum 101*a*. It is desirable to adopt a charging unit of a roller type as the charging unit 103*a*, so that the charging unit 103*a* uniformly charges the surface of the photoreceptor drum 101*a* while preventing generation of ozone as much as possible. The developing unit (developing device) 102*a* forms a toner image by supplying the toner to the electrostatic image which has been formed on the surface of the photoreceptor drum 101 by the light emitted from the optical system unit E. The first transfer unit 13*a* is a transfer device for transferring the toner image formed on the photoreceptor drum 101*a* to the intermediate transfer belt 11. The first transfer unit 13*a* is positioned so as to pressure the photoreceptor drum 101*a* via the intermediate transfer belt 11. The cleaning unit 104*a* removes the toner left on the surface on the photoreceptor drum 101*a* after the toner image is transferred from the photoreceptor drum 101*a*.

Each of the other three visible image forming units pb, pc, and pd has a configuration similar to that of the visible image forming unit pa, so that explanations as to members of each of the visible image forming units pb, pc, and pd are omitted here. Note, however, that developing units 102*b*, 102*c*, and 102*d* have a yellow (Y) toner, a magenta (M) toner, and a cyan (C) toner, respectively, inside thereof.

The intermediate transfer belt 11 is stretched between tension rollers 11*a* and 11*b* along the visible image forming units pa, pb, pc, and pd arranged in a paper carrying direction. On a tension roller 11*b* side, the intermediate transfer belt 11 is in contact with a waste toner box 12, while on a tension roller 11*a* side, the intermediate transfer belt 11 is in contact with the second transfer unit 14. The toner image is formed on the intermediate transfer belt 11 by the first transfer unit 13*a*. Here, in a case where the target image is a color image, the toner image would have a region where a plurality of toners of different colors overlap each other in accordance with colors of the image.

The second transfer unit 14 transfers, to the sheet, the toner image which has been temporarily transferred to the intermediate transfer belt 11.

The fixing device 15 fixes the toner image on the sheet by use of a laser beam. The fixing device 15 includes a laser array 15*a*, and a paper carrying device 15*e*. The laser array 15*a* fuses the toner image by irradiating, with the laser beam, the toner image that has not been fixed yet, so as to fix the toner image on the sheet. The paper carrying device 15*e* carries the sheet. The fixing device 15 is provided in the downstream of the second transfer unit 14 in the paper carrying direction.

The internal paper feeding unit 16 is provided below the optical system unit E, and the manual paper feeding unit 17 is externally attached to a side surface of the image forming apparatus 100. On the top of the image forming apparatus 100, a paper output tray 18 is provided. A sheet on which an image has been printed is placed on the paper output tray 18 in such a manner that a surface on which the image has been printed faces downward.

Further, the image forming apparatus 100 has a paper carrying path S for leading the sheet supplied from the internal paper feeding unit 16 or the manual paper feeding unit 17 to the paper output tray 18 via the second transfer unit 14 and the fixing device 15.

Along the paper carrying path S, paper feeding rollers 16*a* and 17*a*, a registration roller 19, the second transfer unit 14, the fixing device 15, a carrying roller r, and so on, are provided.

The carrying roller is a small roller for accelerating and supporting paper carrying movement. A plurality of carrying rollers r are provided along the paper carrying path S. The paper feeding roller 16*a* is a suction roller for supplying the sheet from the internal paper feeding unit 16 to the paper carrying path S one by one. The paper feeding roller 16*a* is provided at an end of the internal paper feeding unit 16. The paper feeding roller 17*a* is a suction roller for supplying the sheet from the manual paper feeding unit 17 to the paper carrying path S one by one. The paper feeding roller 17*a* is provided in the vicinity of the manual paper feeding unit 17.

The registration roller 19 temporarily holds the sheet carried through the paper carrying path S, and supplies the sheet to a transfer section of the second transfer unit 14 at such timing that an end of a toner image formed on the intermediate transfer belt 11 and an end of the sheet match with each other.

Next, the following description deals with a paper carrying operation. As described above, the image forming apparatus 100 includes the internal paper feeding unit 16 in which sheets are stored in advance, and the manual paper feeding unit 17, which is used in a case where the printing is carried out with respect to a small number of sheets (see FIG. 1). The internal paper feeding unit 16 and the manual paper feeding unit 17 have the paper feeding rollers 16*a* and 17*a*, respectively, so that the sheet is supplied to the paper carrying path S one by one from the internal paper feeding unit 16 or from the manual paper feeding unit 17.

In a case of single-sided printing, the sheet supplied from the internal paper feeding unit 16 is carried to the registration roller 19 by the carrying rollers provided along the paper carrying path S, and then further carried to the transfer section of the second transfer unit 14 by the registration roller 19 at such timing that the end of the sheet and the end of the toner image formed on the intermediate transfer belt 11 match with each other. The transfer section transfers the toner image formed on the intermediate transfer belt 11 to the sheet, and then the toner image is fixed on the sheet by the fixing device 15. After that, the sheet is outputted to the paper output tray 18 by the paper output roller 18*a*.

Meanwhile, the sheet supplied from the manual paper feeding unit 17 is carried to the registration roller 19 by the plurality of carrying rollers r. After that, the sheet is outputted to the paper output tray 18 in the same manner as the sheet supplied from the internal paper feeding unit 16.

On the other hand, in a case of two-sided printing, the sheet that has been subjected to the single-sided printing in the manner described above is carried to the paper output roller 18*a* via the fixing device 15. The paper output roller 18*a* holds a rear end of the sheet, and then rotates in a reverse direction. Thereby, the sheet is lead to a reverse carrying path S'. After a back surface of the sheet is subjected to the printing via the registration roller 19, the sheet is outputted to the paper output tray 18.

Next, the following description deals with the image forming processing carried out by the image forming apparatus 100. The visible image forming unit pa uniformly charges a surface of the photoreceptor drum 101*a* by the charging unit 103*a*. Then, the optical system unit E forms an electrostatic latent image on the surface of the photoreceptor drum 101*a*. After that, the developing unit 102*a* develops the electrostatic latent image formed on the photoreceptor drum 101*a*, so as to form a toner image. The toner image made visible on the photoreceptor drum 101*a* is transferred to the intermediate transfer belt 11 by the first transfer unit 13*a* to which a bias voltage whose polarity is opposite to that of toner is applied. Note that each of the other three visible image forming units pb, pc, and pd forms a toner image in the same manner as the visible image forming unit pa, so that the toner images sequentially overlap each other on the intermediate transfer belt 11.

Then, the toner image formed on the intermediate transfer belt 11 is transferred to a sheet by the second transfer unit 14 to which the bias voltage whose polarity is opposite to that of the toner image is applied. The sheet, on which the toner image has been transferred, is carried to the fixing device 15. The fixing device heats the toner image, which has not been fixed yet, by irradiating the toner image with the laser beam, so that the toner image is fused and bonded to the sheet. After that, the sheet is outputted to the external paper output tray 18 by the paper output roller 18*a*.

Note that the image forming apparatus 100 of the present invention deals with image formation at a speed of 10-70 sheets/minute (A4, long edge feed), for example, and also can deal with low speed printing, high speed printing, black-and-white printing, and color printing. For example, the image forming apparatus 100 analyzes the image data so as to determine which printing is to be carried out: (i) the black-and-white printing or (ii) the color printing. In the case of the black-and-white printing, the high speed printing is carried out at a speed of 70 sheets/minute, while in the case of the color printing, the low speed printing is carried out at a speed of 10 sheets/minute. Such a technique of controlling the printing speed has been well known so that explanations thereof are omitted here.

[Configuration of Fixing Device]

Figure 2:
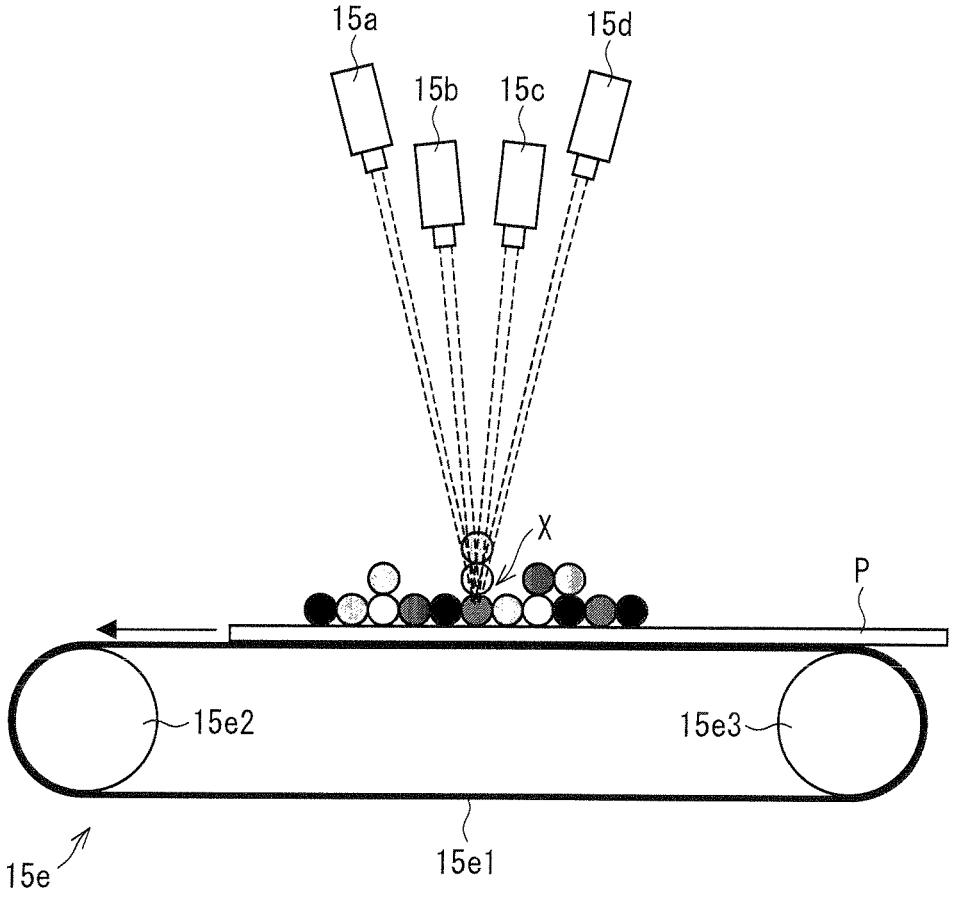
FIG. 2 is an explanatory view illustrating a configuration of the fixing device in accordance with the present embodiment of the present invention.
Figure 3:
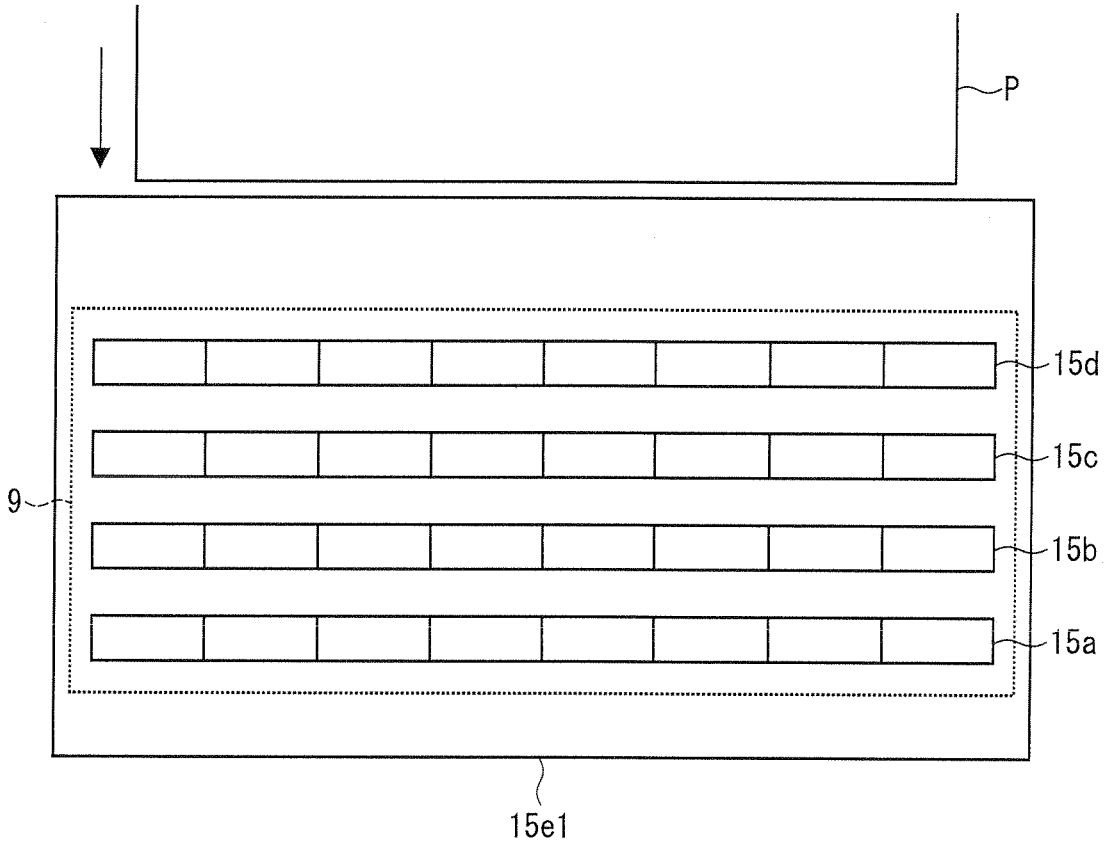
FIG. 3 is a top view illustrating the fixing device of FIG. 2.
Figure 4:
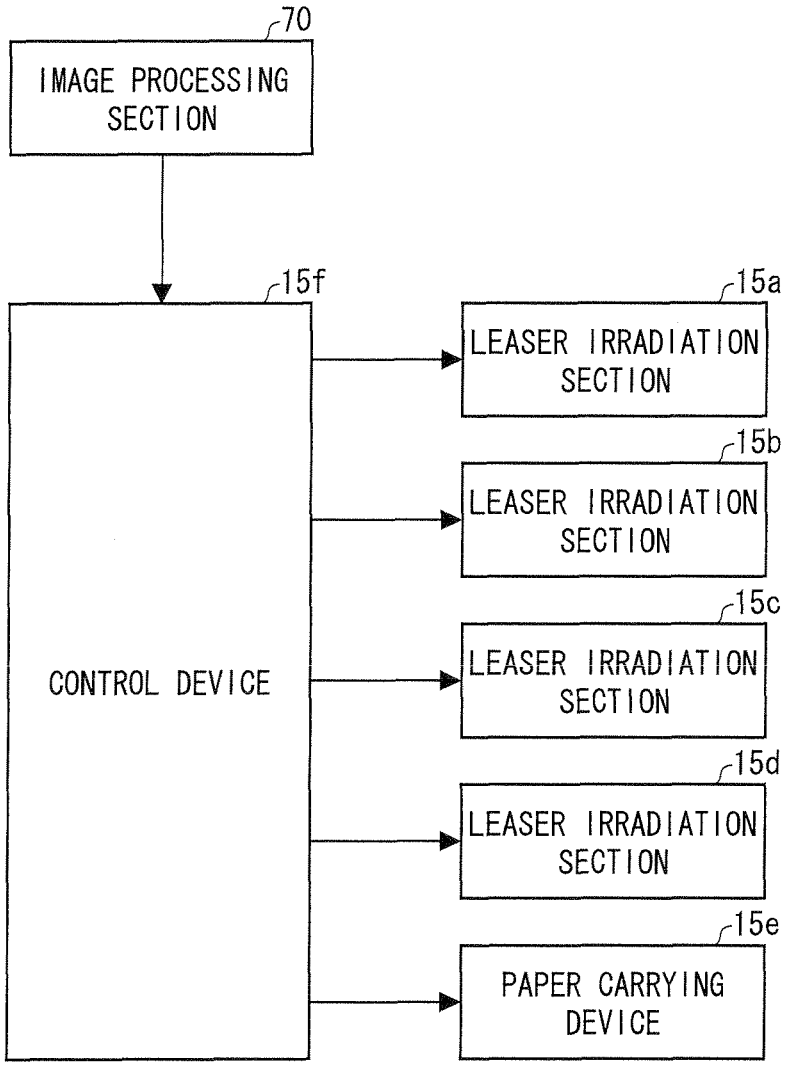
FIG. 4 is a block diagram illustrating hardware included in the fixing device in accordance with the present embodiment of the present invention.

Next, the following description deals with the fixing device (laser fixing device) 15 of the present embodiment in detail with reference to drawings. FIG. 2 is an explanatory view illustrating the fixing device 15 of the present embodiment, and FIG. 3 is a top view schematically illustrating a plurality of laser irradiation sections, which are included in the fixing device 15 of FIG. 2. Further, FIG. 4 is a block diagram showing hardware included in the fixing device 15 of the present embodiment.

The fixing device 15 includes four laser irradiation sections 15*a*, 15*b*, 15*c*, and 15*d*, and the paper carrying device 15*e* (see FIG. 2). The fixing device 15 further includes a control device (control section) 15*f* connected to the laser irradiation sections 15*a* through 15*d* and the paper carrying device 15*e* (see FIG. 4). The control device 15*f* controls how the laser irradiation sections 15*a* through 15*d* and the paper carrying device 15*e* operate.

The fixing device 15 irradiates a sheet P with laser beams emitted from the respective laser irradiation sections 15*a* through 15*d* while carrying the sheet P by the paper carrying device 15*e* (see FIG. 2). On a surface of the sheet P, the toner is fused in a region irradiated with the laser beams emitted from the respective laser irradiation sections 15*a* through 15*d* (hereinafter, referred to as "irradiation spot"). Thereby, the toner is fixed on the sheet P.

According to the present embodiment, the laser irradiation sections 15*a* through 15*d* are arranged in this order along the direction in which the sheet P is carried (see FIGS. 2 and 3). Note, however, that the order of the irradiation sections 15*a* through 15*d* is not limited to this, and may be changed. Further, a heat sink 9 is provided so as to dissipate the heat generated by the laser irradiation sections 15*a* through 15*d* (see FIG. 3).

Which direction each of the laser irradiation sections 15*a* through 15*d* emits its laser beam is set so that the laser irradiation sections 15*a* through 15*d* irradiate, with the laser beams thereof, substantially the same region (a region indicated by "X" point in FIG. 2) on the surface of the sheet P. Specifically, a light path of each of the laser beams emitted from the respective laser irradiation sections 15*a* through 15*d* is not parallel to a normal line with respect to the surface of the sheet P but is oblique to the normal line (vertical direction). That is, the laser irradiation sections 15*a* through 15*d* emits their laser beams so that each of the laser beams has an incident angle with respect to the sheet P. Further, each of the laser irradiation sections 15*a* through 15*d* focuses on a toner existing at the X point so as to irradiate the toner with the laser beam thereof. Therefore, the laser beams emitted from the respective laser irradiation sections 15*a* through 15*d* travel to the X point at their respective incident angles, and gather together at the X point.

The following description explains the reason why the light paths of the laser beams emitted from the respective laser irradiation sections 15*a* through 15*d* are set to be different from the normal line with respect to the surface of the sheet P.

In a case where a color image is formed on the sheet P, there would be a region where a plurality of toners of different colors overlap each other on the surface of the sheet P (see FIG. 2). If the laser beam is emitted, in the normal direction with respect to the surface of the sheet P, to the region where the plurality of toners of different colors overlap each other (multilayer region), that is, if the laser beam is emitted so as to be subject to regular reflection, there is a risk that only a toner provided as an uppermost layer might be irradiated with the laser beam, and a toner provided as a lowermost layer might not be irradiated with the laser beam at all. This may cause a failure in fusion bonding of the toner. In order to solve the problem, it is necessary to increase intensity of the laser beam, for example. However, in the present embodiment, each of the laser irradiation sections 15*a* through 15*d* irradiates the sheet P with the laser beam in the direction oblique to the direction vertical to the surface of the sheet P (that is, the laser beam is emitted in the direction which does not cause the laser beam to be subjected to the regular reflection). Therefore, it is possible to irradiate all toners (from the toner provided as the uppermost layer to the toner provided as the lowermost toner) with the laser beams. Accordingly, the intensity of the laser beam does not have to be unnecessarily increased to more than required.

The irradiation of the laser beam causes the toner to be fused. As a result, the toner is deformed and the deformed toner penetrates into pulp fiber of the sheet P. Then, the toner is cooled so as to be solidified. Thereby, the toner is fixed on the sheet P. Here, in a case where the plurality of laser irradiation sections 15*a* through 15*d* irradiate the toner with their laser beams in turn with relatively long time intervals, there may be a reduction in heating efficiency in fusing the toner by the irradiation of the laser beams. The following description deals with how such reduction is caused. First irradiation of the laser beam starts fusing the toner but cannot fuse the toner completely, and then the toner starts being solidified after the first irradiation. Then, second irradiation starts fusing the toner which has already started being solidified due to the time interval between the first and second irradiation. Therefore, the heating efficiency is reduced. Note that the reduction in heating efficiency depends on a fusion property of that toner to a certain degree.

The arrangement illustrated in FIG. 2 allows the laser irradiation sections 15*a* through 15*d* to irradiate the toner with their laser beams at substantially the same time. Therefore, it becomes possible to fuse the toner more quickly. The toner fused in such a shorter period of time can be successfully fixed on a recording sheet. Note that it is preferable that the laser irradiation sections 15*a* through 15*d* irradiate exactly the same spot with their laser beams. However, in order to cause the laser irradiation sections 15*a* through 15*d* to irradiate exactly the same spot with their laser beams, it is necessary to take into consideration alignment accuracy, optical aberration, and the like. This causes an increase in cost. On that account, it is also possible that the laser irradiation sections 15*a* through 15*d* irradiate the toner with their laser beams so that the laser beams partially overlap each other on the toner. Note that in a case where it is demanded, for the heating efficiency of the respective laser irradiation sections 15*a* through 15*d*, that the irradiation sections 15*a* through 15*d* irradiate exactly the same spot with their laser beams, a well-known adjustment mechanism may be provided to adjust the light paths.

The laser irradiation sections 15*a* through 15*d* may be provided on a single substrate, or provided independently as illustrated in FIG. 2. Note, however, that in the case where the laser irradiation sections 15*a* through 15*d* are provided on the single substrate, there would be a problem of an increase in cost. This is because, in order to cause the laser beams from the laser irradiation sections 15*a* through 15*d* to gather together at the X point, it is necessary to precisely align, on the single substrate, the laser irradiation sections 15*a* through 15*d*, each of which includes optical members, e.g. a semiconductor laser and a lens. Therefore, it is preferable to provide the four laser irradiation sections 15*a* through 15*d* independently, as illustrated in FIG. 2.

Each of the laser irradiation sections 15*a* through 15*d* includes such a laser array that a plurality of semiconductor laser elements are arranged in a width direction of the sheet (i.e. the direction vertical to the direction in which the sheet is carried), as described later. As compared with other lasers, such as a carbon dioxide gas laser, the semiconductor laser element has advantages of its reasonable price and small body. Further, in a process of forming the semiconductor laser element on the substrate, it is possible to arbitrarily determine, in a wide range, a structure, a compounding ratio of materials, and a material composition of the semiconductor laser element. Therefore, it is possible to arbitrarily determine a wavelength of a laser beam in a range of 400 nm to 800 nm, and cause the semiconductor laser element to oscillate the laser beam having such a wavelength to irradiate the toner with the laser beam.

In the present embodiment, the laser irradiation sections 15*a* through 15*d* emit laser beams of different wavelengths, respectively. Specifically, the laser irradiation section 15*a* emits a laser beam having a wavelength which can be easily absorbed by a black toner, the laser irradiation section 15*b* emits a laser beam having a wavelength which can be easily absorbed by a yellow toner, the laser irradiation section 15*c* emits a laser beam having a wavelength which can be easily absorbed by a magenta toner, and the laser irradiation section 15*d* emits a laser beam which can be easily absorbed by a cyan toner.

The laser beam is coherent light which is a collection of light having the same wavelength, and has a particular narrow wavelength band. In a case where the wavelength of the laser beam and an absorption wavelength of the target toner coincide with each other, irradiation energy of the laser beam is absorbed by the toner. The absorbed irradiation energy becomes heat energy, so that the toner is fused.

In the present embodiment, "wavelength which can be easily absorbed by the toner" means a wavelength exhibiting an absorbance (absorption rate) of 80% or more, which absorbance is measured in the following manner. Here, "absorbance" indicates how much degree a material absorbs light. The absorbance is a value representing a common logarithm of an inverse of a transmittance. In a case where the absorbance is less than 80%, the toner cannot sufficiently absorb the irradiation energy of the laser beam. As a result, the toner cannot be sufficiently fixed.

The following description deals with a method of measuring the absorbance in detail. First, the target toner corresponding to each of the colors (black, yellow, magenta, cyan) is dissolved in a THF (tetrahydrofuran) solvent, and a concentration of the toner is adjusted to be 0.018%. The adjusted solution is provided in a quartz cell having a size of 1 cm×1 cm (i.e. a distance of 1 cm by which light passes through the solution in a light traveling direction in a light path of a spectralphotometer), and then a transmittance of the solution is measured in a range of 300 nm to 800 nm by the spectralphotometer. Note that the spectralphotometer used in the measurement is Spectralphotometer U-3300 (manufactured by Hitachi Ltd.). In the measurement of the transmittance, the lowest peak of the transmittances is assumed to be an absorbance of 100%, and a part having a transmittance of 100% is assumed to have an absorbance of 0%. On the basis of these values, the common logarithm of the inverse of the transmittance can be found. In this manner, the absorbance can be found for each wavelength. Note that in a case where the transmittance of 0% is continuously found in a wide wavelength band, it is assumed that the concentration of 0.018 is too high. In this case, the lowest peak of the transmittances may be found by causing the concentration to be lower.

Figure 5:
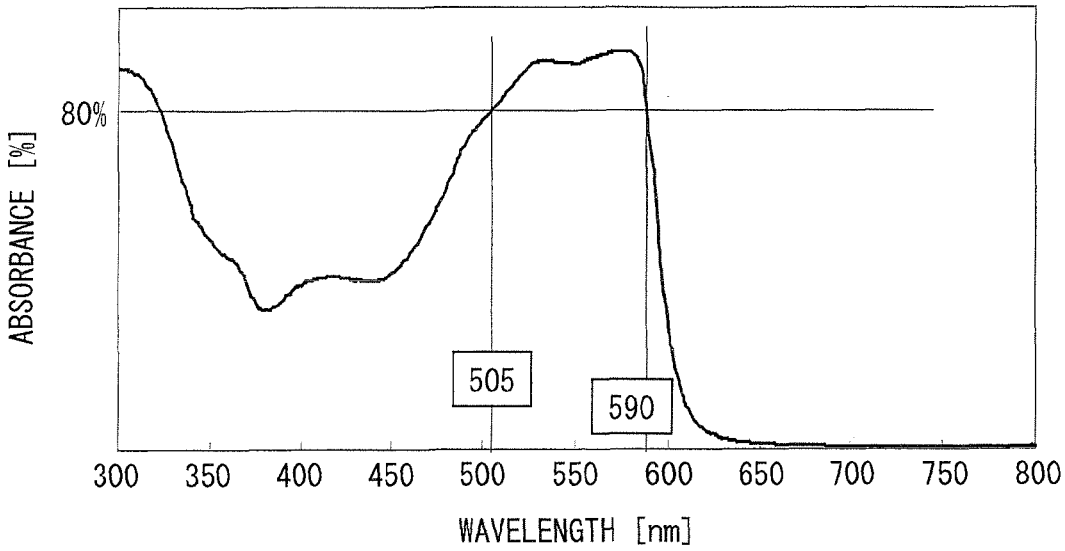
FIG. 5 is a view showing a light-absorption spectrum of a cyan toner.
Figure 6:
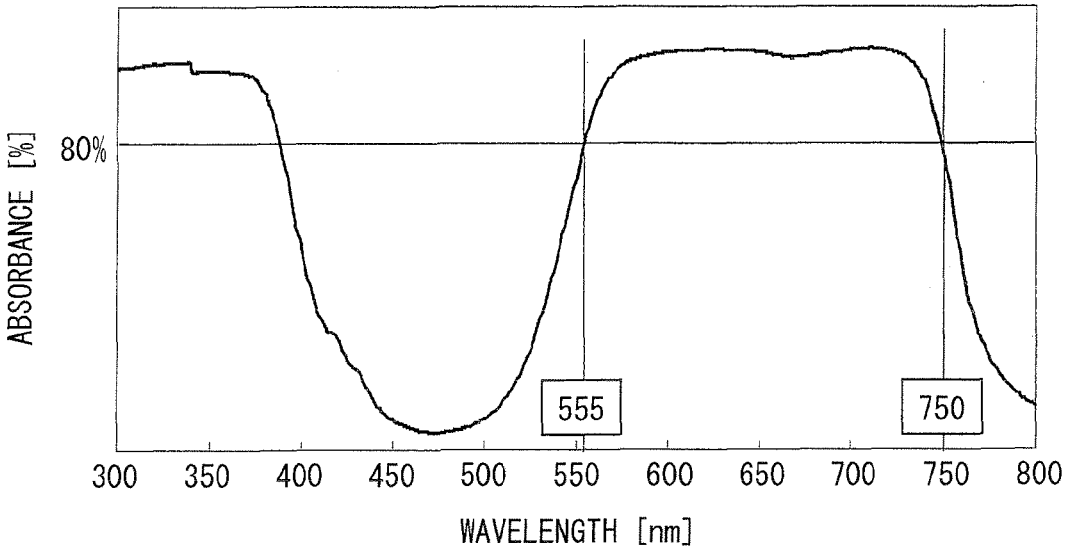
FIG. 6 is a view showing a light-absorption spectrum of a magenta toner.
Figure 7:
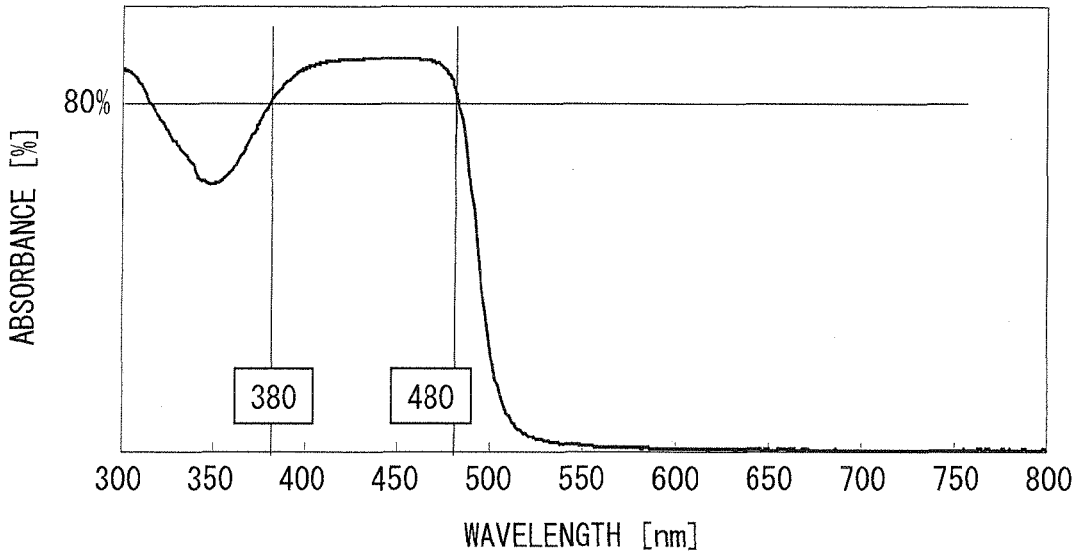
FIG. 7 is view showing a light-absorption spectrum of a yellow toner.
Figure 8:
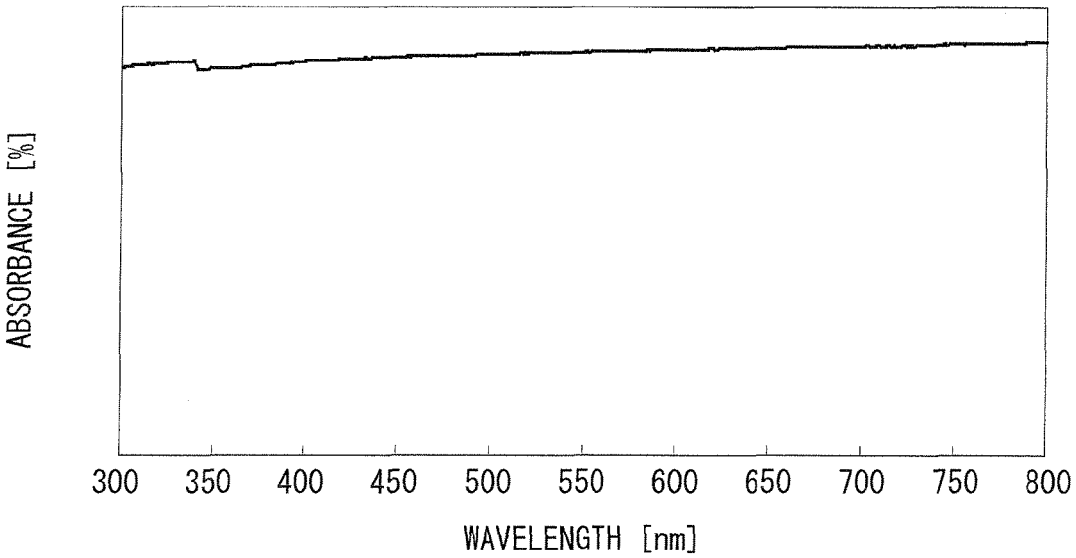
FIG. 8 is a view showing a light-absorption spectrum of a black toner.

Each of FIGS. 5 through 8 shows a result of the measurement of an absorbance in accordance with the aforementioned method, for example. The measurement is carried out with respect to each of the toners (black, yellow, magenta, cyan) used in a multifunctional apparatus (MX-7001N, manufactured by SHARP Co.). FIG. 5 is a view showing an optical absorption spectrum of the cyan toner. FIG. 6 is a view showing an optical absorption spectrum of the magenta toner. FIG. 7 is a view showing an optical absorption spectrum of the yellow toner. FIG. 8 is a view showing an optical absorption spectrum of the black toner.

The cyan toner has an absorbance of 80% or more with respect to light having a wavelength in a range of 505 nm to 590 nm (see FIG. 5). For this reason, the laser irradiation section 15*d* corresponding to the cyan toner irradiates the cyan toner with a laser beam having a wavelength determined within the range of 505 nm to 590 nm (e.g. 550 nm). The magenta toner has an absorbance of 80% or more with respect to light having a wavelength in a range of 555 nm to 750 nm (see FIG. 6). For this reason, the laser irradiation section 15*c* corresponding to the magenta toner irradiates the magenta toner with the laser beam having a wavelength determined within the range of 555 nm to 750 nm (e.g. 650 nm). The yellow toner has an absorbance of 80% or more with respect to light having a wavelength in a range of 380 nm to 500 nm. For this reason, the laser irradiation section 15*b* corresponding to the yellow toner irradiates the yellow toner with the laser beam having a wavelength determined within the range of 380 nm to 500 nm (e.g. 450 nm). As described above, each of the laser irradiation sections 15*b* through 15*d*, which correspond to the cyan toner, the magenta toner, and the yellow toner, respectively, emits the laser beam exhibiting an absorbance of 80% or more in the light-absorption peak region of the corresponding toner.

Meanwhile, the black toner has a high absorbance throughout a whole wavelength band (see FIG. 8). For this reason, the laser irradiation section 15*a* corresponding to the black toner irradiates the black toner with a laser beam having a wavelength determined within a range of 400 nm to 850 nm (e.g. 750 nm).

Note that the toner image is made of toners contained in a developer, such as a nonmagnetic single component developer containing a nonmagnetic toner, a nonmagnetic two component developer containing a nonmagnetic toner and a carrier, or a magnetic developer containing a magnetic toner. As described above, each of the color toners (yellow, magenta, cyan) has a lower absorbance with respect the laser beam than that of the black toner. Therefore, an infrared absorbing material may be added to each of the color toners so that each of the color toners has an absorbance substantially equal to that of the black toner. Examples of the infrared absorbing material encompass phthalocyanine, polymethine, cyanine, onium, a nickel complex, and any combination thereof. For example, the color toner contains, as an internal additive, phthalocyanine (i.e. an infrared absorbing material) in a range of 1 part by weight to 5 parts by weight with respect to 100 parts by weight of a main binder resin.

Next, the following description deals with the paper carrying device 15*e*. The paper carrying device 15*e* includes a carrying belt 15*e*1, a driving roller 15*e*2, a driven roller 15*e*3, and a driving motor (not illustrated) (see FIG. 2).

The carrying belt 15*e*1 is made of a polyimide resin, and has a thickness of 75 (μm) and a volume resistivity of $1.0\times10^{16}$ (Ω·cm). The carrying belt 15*e*1 is a heat-resisting belt member having no ends, stretched between the driving roller 15*e*2 and the driven roller 15*e*3.

The control device 15*f* drives the driving motor so that the driving roller 15*e*2 is rotated at a predetermined rotation speed. That is, the carrying belt 15*b*1 is moved by the rotation of the driving roller 15*e*2 in a direction indicated by an arrow in FIG. 2, at a speed Vp (mm/sec) at which the sheet is carried. Note that in accordance with content of the image data, the control device 15*f* can change the speed Vp at which the sheet is carried. Specifically, the control device 15*f* sets a relatively high speed as the Vp in the case of the black-and-white printing, while setting a relatively low speed as the Vp in the case of the color printing.

The paper carrying device 15*e* having such an arrangement supplies the sheet P received from the second transfer unit 14 to a surface of the carrying belt 15*e*1.

The driven roller 15*e*3 is made of a conductive material, and is connected to ground. At a position on the surface of the carrying belt 15*e*1, where the carrying belt 15*e*1 faces the driven roller 15*e*3, an electric charge is applied to the sheet P by an absorption charger (not illustrated), so that dielectric polarization between the sheet P and the carrying belt 15*e*1 is caused. This causes the sheet P to be electrostatically absorbed to the surface of the carrying belt 15*e*1.

The carrying belt 15*e*1 is driven by the driving roller 15*e*2 to move in the direction indicated by the arrow in FIG. 2. Thereby, the sheet P absorbed to the surface of the carrying belt 15*b*1 is carried to a region which is being irradiated with the laser beams.

[Configuration of Laser Irradiation Section]

Figure 9:
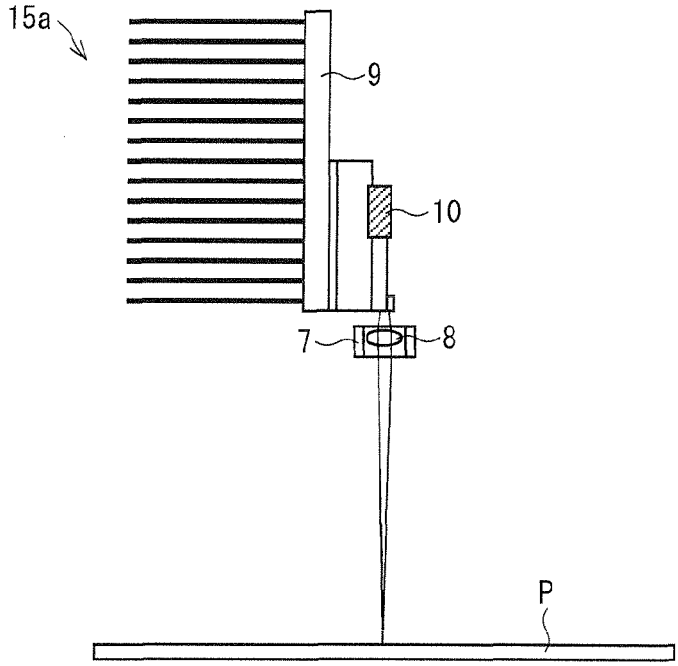
FIG. 9 is a side view schematically illustrating a laser irradiation section.
Figure 10:
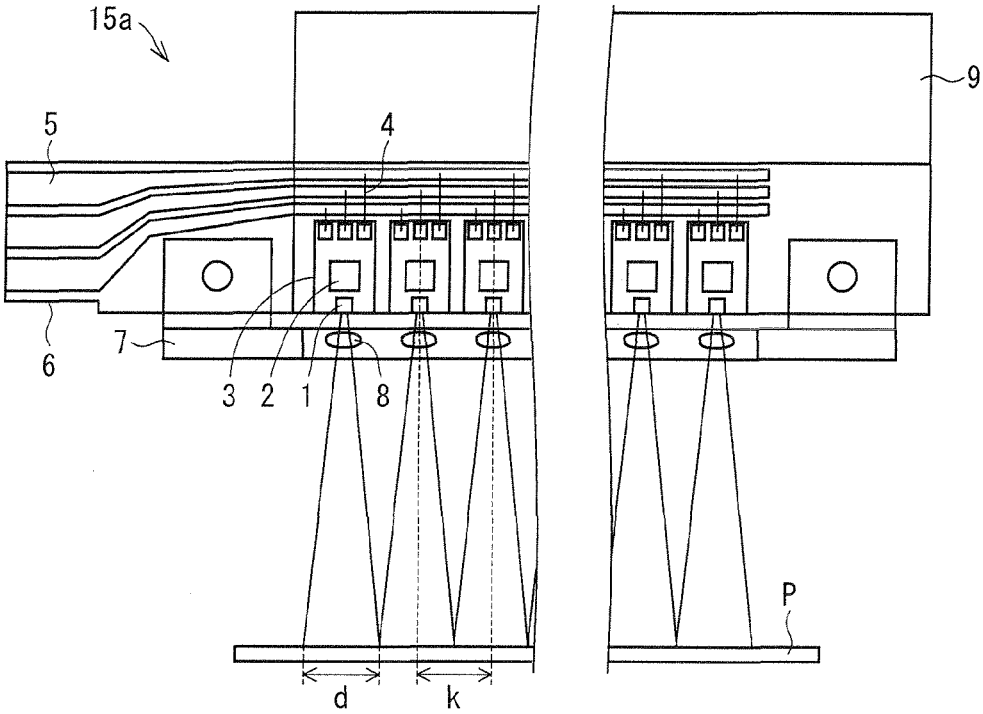
FIG. 10 is a front view schematically illustrating the laser irradiation section.

Next, the following description deals with a configuration of each of the laser irradiation sections in detail. FIG. 9 is a side view schematically illustrating the laser irradiation section, and FIG. 10 is a front view schematically illustrating the laser irradiation section. Although either FIG. 9 or FIG. 10 illustrates only a single laser irradiation section 15*a*, each of the other laser irradiation sections 15*b* through 15*d* has the same arrangement as that of the laser irradiation section 15*a*. Although it seems that the laser beam is emitted in the direction of the normal line with respect to the sheet P in FIG. 9, the laser beam is actually emitted in a direction oblique to the normal line, as illustrated in FIG. 2.

As illustrated in FIGS. 9 and 10, the laser irradiation section 15*a* is configured such that (i) a control circuit (not illustrated) and a photodiode 2 are formed on a silicon substrate 3 monolithically, a semiconductor laser element (chip) 1 is provided on the silicon substrate 3, and (iii) the semiconductor laser element 1 and the silicon substrate 3 is electrically connected to each other via a wire bonding line 4. The control circuit (i) causes a laser beam output to be variable by use of an input signal, or (ii) maintains a laser output (light intensity of the laser beam) at a certain value by use of a signal received from the monitoring photodiode 2 which is a light receiving element.

A plurality of silicon substrates 3, each having the semiconductor laser element 1, are arranged in a line on a ceramic substrate 6. A surface electrode 5 of the ceramic substrate 6 and electrodes of the respective silicon substrates 3 are electrically connected to each other by wire bonding or the like. Further, the heat sink (heat dissipation plate) 9, and a lens holder 7 which holds a plurality of convex lenses (i.e. a plurality of light condensing systems), are attached to the ceramic substrate 6 on which the plurality of semiconductor laser elements 1 are aligned. The laser irradiation section 15*a* has such an arrangement.

The semiconductor laser element 1 has a wide beam divergence angle. However, the light condensing system condenses light and focus the light on a point, so that the heating efficiency is increased. The light condensing system may be another lens or a mirror.

The plurality of convex lenses 8 and the lens holder 7 may be such that the plurality of convex lenses 8 are incorporated into a resin holder or the like. However, in the present invention, it is preferable to use (i) the one in which the lenses and the lens holder are made integral by use of a resin, or (ii) a lens array, such as a plate micro lens, which is manufactured such that a glass plate is subjected to ion exchange so as to have lens portions. This is because such an arrangement is advantageous in cost, convenience in the process, and assembly accuracy.

It is also possible for the laser irradiation sections to irradiate the toner image with the laser beams which are in a form of parallel light, without the light condensing systems.

Further, a thermistor 10 for measuring the temperature is provided on the ceramic substrate 6. The thermistor 10 is arranged at a center of the fixing device 15 in a longitudinal direction of the fixing device 15 (that is, a direction which is (i) vertical to the direction in which the sheet P is carried, and (ii) parallel to the surface of the sheet P). On the basis of temperature data detected by the thermistor 10, the control device 15*f* controls a voltage to be applied to the semiconductor laser element 1, so as to control an output of the semiconductor laser element 1.

As described above, the laser irradiation section 15*a* includes: the semiconductor laser array constituted by the plurality of semiconductor laser elements 1 aligned in a line in the longitudinal direction of the fixing device (that is, the direction which is (i) vertical to the direction in which the sheet P is carried, and (ii) parallel to the surface of the sheet P); the heat sink; and the thermistor. Thereby, the laser irradiation section 15*a* can irradiates, with the laser beams, a plurality of spots (hereinafter, referred to as "irradiation sub spots") along the width direction of the sheet P.

For example, the semiconductor laser array of the laser irradiation section 15*a* for the black toner is such that 1,000 semiconductor laser elements 1, each of which emits a laser beam having a wavelength of 750 nm and has a fixed output of 150 mW, are aligned. In this case, an alignment pitch p between the semiconductor laser elements is 0.3 mm, and a diameter of each laser spot d is also 0.3 mm. The laser irradiation section 15*a* can irradiate, with the laser beams, 1,000 irradiation sub spots along the width direction of the sheet P.

The heat sink may be such that 10 heat sinks (UB30-20B manufactured by Alpha Company Ltd.), each of which is made of an aluminum alloy and has a base size of 30 mm×30 mm, a height of 20 mm, and a thermal resistance of 1.6° C./W, are aligned in a line (a total thermal resistance of 0.16° C./W).

Each of the other laser irradiation sections 15*b* through 15*d* has basically the same arrangement as that of the laser irradiation section 15*a*. Note, however, that it is possible to appropriately determine the fixed output of a single semiconductor laser element 1, the number of the semiconductor laser elements 1 to be aligned, and the alignment pitch. Further, it is also possible to appropriately determine a size of the heat sink in accordance with a total output and a heat generation rate of that laser irradiation section. Furthermore, it is possible that all of the laser irradiation sections 15*a* through 15*d* have the same arrangement (the heat sink, the substrate, etc.) except for the wavelength of the laser beam emitted from the semiconductor laser element 1 (i.e. except for only the semiconductor laser element 1). In this case, it is possible to have a reduction in cost.

[Control by Control Device]

Next, the following description deals with how the control device 15*f* controls the laser irradiation sections 15*a* through 15*d*, which is a special feature of the present embodiment. In the present embodiment, the control device 15*f* controls the laser irradiation sections 15*a* through 15*d* so that with respect to a spot where the toner image is made of only a single toner (e.g. the black toner), (i) the laser irradiation section corresponding to the toner emits the laser beam thereof, and (ii) another laser irradiation section also emits the laser beam thereof (i.e. the toner is irradiated with not only the laser beam emitted from the corresponding laser irradiation section but also the laser beam emitted from another laser irradiation section). That is, the control device 15*f* controls a plurality of laser irradiation sections to irradiate, with their laser beams, the spot where the single toner is formed (where a single color image is formed).

According to a conventional technique, a single laser irradiation section irradiates the toner with the laser beam thereof. This makes it necessary to set the fixed output of the laser irradiation section to be high in order to fuse the toner by use of the laser irradiation section only. Accordingly, it is necessary to adopt a laser irradiation section having a relatively high fixed output, as each of the laser irradiation sections corresponding to the respective toners. This increases the cost and size of each of the laser irradiation sections.

However, in the present embodiment, a plurality of laser irradiation sections 15*a* through 15*d* irradiate the toner with the laser beams thereof. This allows the fixed output of each of the laser irradiation sections 15*a* through 15*d* to be low. Therefore, it is possible to prevent the cost and size of each of the laser irradiation sections 15*a* thorough 15*d* from being increased.

The control device controls the laser irradiation sections 15*a* through 15*d* as described in the following Control Examples 1 through 3, for example.

CONTROL EXAMPLE 1

As shown in FIG. 8, the black toner can absorb light throughout a wide wavelength range, and has a high absorbance with respect to even the laser beams emitted from the laser irradiation sections 15*b* through 15*d*, corresponding to the yellow toner, the magenta toner, and the cyan toner, respectively. Therefore, the control device 15*f* controls the laser irradiation sections 15*a* through 15*d* so that with respect to a spot where the toner image is made of the black toner, not only the laser irradiation section 15*a* for the black toner but also the laser irradiation sections 15*b* through 15*d* emit the laser beams thereof. This allows the black toner to be fused by the laser beams emitted from all of the laser irradiation sections 15*a* through 15*d*.

CONTROL EXAMPLE 2

As described above, in the case where each of the color toners, i.e. the yellow toner, the magenta toner, and the cyan toner, contains the infrared absorbing material, the toner can absorb, at a high absorbance (e.g. more than a predetermined threshold value of 70%), a laser beam whose wavelength corresponds to the infrared absorbing material. Therefore, the color toner can also be heated with such a laser beam. For this reason, the laser irradiation section 15*a* for the black toner is set so as to emit light having a wavelength which can be absorbed by the infrared absorbing material (e.g. light having a wavelength of 750 nm). In this case, the following control can be carried out. That is, the control device 15*f* controls the laser irradiation sections 15*a* through 15*d* so that (i) with respect to the yellow toner, the laser irradiation section 15*b* for the yellow toner and the laser irradiation section 15*a* for the black toner emit their laser beams, (ii) with respect to the magenta toner, the laser irradiation section 15*c* for the magenta toner and the laser irradiation section 15*a* for the black toner emit their laser beams, and (iii) with respect to the cyan toner, the laser irradiation section 15*d* for the cyan toner and the laser irradiation section 15*a* for the black toner emit their laser beams. This allows each of the color toners (yellow, magenta, cyan) to be fused by the laser beams emitted from two laser irradiation sections.

In the case where the control device 15*f* controls the laser irradiation section 15*a* for the black toner to additionally irradiate other toners with the laser beam thereof, it is preferable to control the laser irradiation section 15*a* for the black toner such that (i) the fixed output of the laser irradiation section 15*a* is larger than an output required for a normal operation, (ii) in a normal state, the output is suppressed, and (iii) in a case where the laser irradiation section 15*a* is required to additionally irradiate another color toner with the laser beam thereof, the output is increased/decreased in accordance with the image data. This can enhance the fusion of the color toner by additionally irradiating the color toner with the laser beam emitted from the laser irradiation section 15*a*. Therefore, the fixing property can be improved.

Further, since the infrared absorbing material absorbs an infrared ray contained in the laser beam, the color toner can acquire more irradiation energy. This further accelerates the fusion of the color toner. However, in a case where the infrared absorbing material is added to the color toner excessively, development of a color of a color material contained in the color toner is inhibited. This causes a decrease in brightness of the color toner.

In order to avoid this, the following setting can be employed. That is, since a plurality of laser irradiation sections emit a plurality of laser beams, respectively, the amount of the infrared absorbing material to be added is determined per color toner. Each of the color toners contains the infrared absorbing material in a corresponding amount that allows a maximum absorbance with respect to the infrared ray under a condition where that color toner does not become less bright. Such an amount is determined in accordance with a spectral property of each of the color toners, e.g. a spectral intensity in an infrared region, which spectral intensity is obtained from such a spectral property that the plurality of laser beams overlap each other.

This can accelerate the fusion of each of the color toners even with little laser power, so that the toner can be fixed on the sheet. Further, it becomes possible to have a reduction in electric power required by each of the laser irradiation sections, a reduction in the amount of heat generated by the laser irradiation sections 15*a* through 15*d*, and/or a reduction in size of each of the laser irradiation sections 15*a* through 15*d*.

Note that in the case of Control Example 2, even if two-color printing is carried out by use of, for example, the magenta toner (alternatively, the cyan toner or the yellow toner) and the black toner, or three-color printing is carried out, it is possible to irradiate each of the color toners with the laser beams emitted from the plurality of laser irradiation sections. Accordingly, it becomes possible to constitute a fixing device which can efficiently fix the toner image with laser beams without an increase in output of each of the laser irradiation sections 15*a* through 15*d*, or an increase in size of each of the laser irradiation sections 15*a* through 15*d*.

CONTROL EXAMPLE 3

As shown in FIGS. 5 and 6, either the cyan toner or the magenta toner can absorb, at an absorbance of 80% or more, light having a wavelength in a range of 555 nm to 590 nm.

Figure 11:
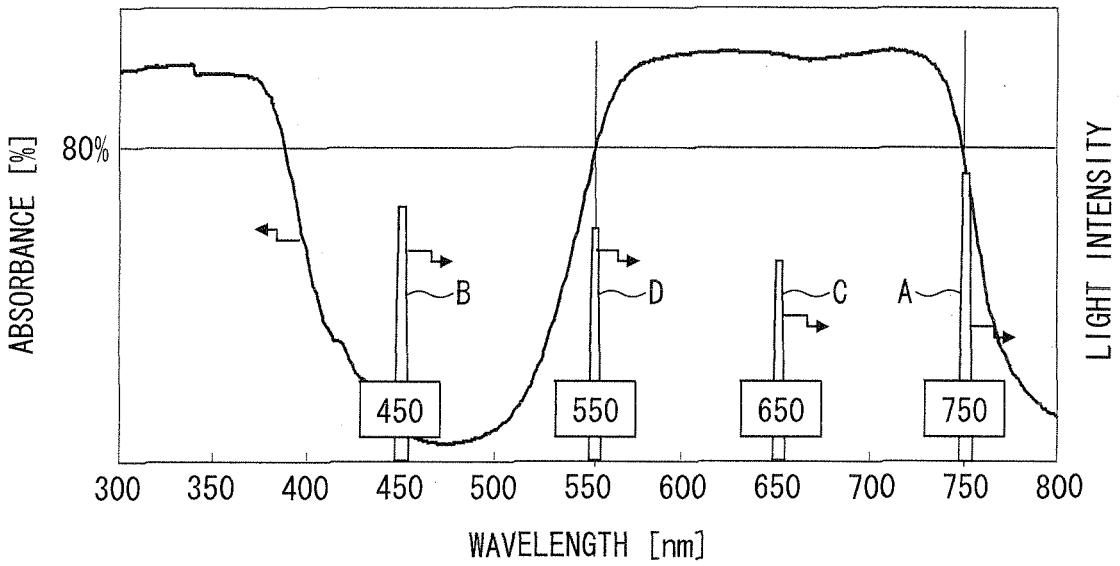
FIG. 11 is a view showing an example of a relationship between the light-absorption spectrum of the magenta toner and wavelengths of laser beams emitted from respective laser irradiation sections 15*a* through 15*d*.

FIG. 11 is a view showing an example of a relationship between the absorption spectrum of the magenta toner, and a wavelength of the laser beam emitted from each of the laser irradiation sections 15*a* through 15*d*. In FIG. 11, a sign "A" indicates a wavelength (750 nm) of the laser beam emitted from the laser irradiation section 15*a* for the black toner, a sign "B" indicates a wavelength (450 nm) of the laser beam emitted from the laser irradiation section 15*b* for the yellow toner, a sign "C" indicates a wavelength (650 nm) of the laser beam emitted from the laser irradiation section 15*c* for the magenta toner, and a sign "D" indicates a wavelength (550 nm) of the laser beam emitted from the laser irradiation section 15*d* for the cyan toner. As shown in FIG. 11, the magenta toner has an absorbance of 80% or more with respect to not only the laser beam emitted from the laser irradiation section 15*c* for the magenta toner but also the laser beam emitted from the laser irradiation section 15*d* for the cyan toner. Therefore, in the example shown in FIG. 11, the control device 15*f* controls the laser irradiation section 15*c* for the magenta toner and the laser irradiation section 15*d* for the cyan toner to irradiate the magenta toner with their laser beams.

Note that FIG. 11 shows only an example, and the wavelengths of the laser beams in FIG. 11 can be determined appropriately. For example, the semiconductor laser element 1 of the laser irradiation section 15*d* for the cyan toner may be set to emit a laser beam having a wavelength of 555 nm, and the semiconductor laser element 1 of the laser irradiation section 15*c* for the magenta toner may be set to emit a laser beam having a wavelength of 590 nm. With this setting, the following control can be carried out. That is, the controls device 15*f* controls the laser irradiation sections 15*d* for the cyan toner and 15*c* for the magenta toner to (i) irradiate the cyan toner with their laser beams, and (ii) irradiate the magenta toner with their laser beams. This allows either the cyan toner or the magenta toner to be fused with the laser beams emitted from the two laser irradiation sections 15*c* and 15*d*. In this case, the infrared absorbing material may or may not be added to the cyan toner and the magenta toner.

The present invention is not limited to an embodiment in which all of the aforementioned Control Examples 1 through 3 are carried out. An embodiment of the present invention may be the one in which at least one of the aforementioned Control Examples 1 through 3 is carried out.

For example, the control device 15*f* may carry out the control in accordance with the aforementioned Control Example 1 only. Further, in a case where the toner image includes a part which is formed by use of the black toner, the control device 15*f* may carry out the control in accordance with the aforementioned Control Example 1 either in any cases, or only in the case of the high-speed black-and-white printing.

In the case of the high-speed black-and-white printing (e.g. the high-speed black-and-white printing at a speed in a range of 60 sheets/minute to 120 sheets/minute), larger irradiation energy is required for the toner per unit time due to a high speed at which the sheet P is carried. If the irradiation energy is insufficient, the toner cannot be fused and softened sufficiently. As a result, the toner cannot be fixed on the sheet successfully, so that a fixing defect is generated. In such a mode, it is necessary to fuse the black toner in a short period of time. However, in order to fuse the black toner by use of the laser irradiation section 15*a* for the black toner only, it is necessary to set maximum irradiation energy (fixed output) of the laser irradiation section 15*a* for the black toner to be larger. This causes an increase in size of the laser irradiation section 15*a*. In view of the problem, according to the present embodiment, the control device 15*f* controls the laser irradiation sections 15*b* through 15*d* to compensate such a shortage of irradiation energy, which shortage cannot be compensated by the laser irradiation section 15*a* for the black toner only. This prevents an unnecessary increase in the fixed output of the laser irradiation section 15*a*, while making it possible to manufacture the laser irradiation sections 15*a* through 15*d* at low cost. Further, it becomes possible to prevent a reduction in the fixing property even in the case of the high-speed printing which causes a shortage of the irradiation energy.

(Control of Output of Laser Irradiation Section)

As described above, according to the present embodiment, the control device 15*f* controls the laser irradiation sections 15*a* through 15*d* so that with respect to a certain toner, not only the laser irradiation section corresponding to the certain toner but also the laser irradiation section(s) corresponding to another toner(s) irradiates the certain toner with the laser beam(s) thereof. Note, however, that in a case where the toner is irradiated with excess laser beams, an air bubble is generated inside the toner, i.e. a blister. The blister results in an image defect. In view of the problem, according to the present embodiment, the light intensity (optical output) of the laser beam emitted from each of the laser irradiation sections 15*a* through 15*d* is adjusted so as to prevent an excess of the irradiation energy. The adjustment is carried out in accordance with the followings: an amount of an adhering toner; an amount of the added infrared absorbing material; a sort of color material; an amount of the color material; a sort of main resin; an amount of an internal additive; an amount of an external additive; a sort of internal additive; a sort of external additive; and so on. An example of how to control the light intensity of the laser beam emitted from each of the laser irradiation sections 15*a* through 15*d* is described below.

The control device 15*f* for controlling the laser irradiation sections 15*a* through 15*d* is connected to an image processing section 70 (see FIG. 4). The image processing section 70 (i) carries out image processing with respect to the image data externally supplied, controls the exposure system unit E on the basis of the image data which has been subjected to the image processing, and (iii) forms a latent image on the photoreceptor drum in accordance with the image data. That is, the image data also function as data indicating where the toner image is formed on the sheet P.

The control device 15*f* (i) receives the image data from the image processing section 70, and (ii) controls light sources (semiconductor laser elements 1) of the respective laser irradiation sections 15*a* through 15*d* to be turned on/off so that the area on the sheet P, where the toner image is formed, is selectively irradiated with the laser beams. Further, the control device 15*f* controls, for each of the laser irradiation sections 15*a* through 15*d*, the light intensity of the laser beam emitted from the semiconductor laser element 1, on the basis of the image data.

Specifically, on the basis of the image data received from the image processing section 70, the control device 15*f* finds, per irradiation sub spot, a required energy amount En which is an amount of energy required to fuse the target toner on the sheet P.

Here, the required energy amount En is a minimum amount of energy necessary to fix, on the sheet P, the target toner adhering to the target irradiation sub spot by fusing the target toner. As illustrated in FIG. 10, on the sheet P, an area in the irradiation sub spot having a laser spot diameter d is irradiated with the laser beam emitted from the semiconductor laser element 1. That is, the required energy amount En varies in accordance with an amount of the toner adhering to the area in the irradiation sub spot having the laser spot diameter d.

The control device 15*f* may find the required energy amount En in the following manner, for example. First, the control device 15*f* previously stores, per toner of different colors, a table or a relational expression showing a corresponding relationship between features indicating an amount of an adhering toner and a minimum amount of energy necessary to fuse the adhering toner. On the basis of the image data, the control device 15*f* finds, for each of the semiconductor laser element 1, the features corresponding to the amount of the adhering toner in the irradiation sub spot which is to be irradiated with the laser beam emitted from that semiconductor laser element 1. Next, the control device 15*f* finds, by use of the table or the relational expression, the energy amount corresponding to the found features, and determines the energy amount as the required energy amount En. Here, the features may be a total of concentration values of the target color, existing in a plurality of pixels in the irradiation sub spot.

Next, the control device 15*f* sets, for each of the irradiation sub spot, the light intensity of the laser beam emitted from each of the laser irradiation sections 15*a* through 15*d* so that the required energy amount En is equal to a total amount of the irradiation energy applied to the toner by the laser beams emitted from the plurality of laser irradiation sections 15*a* through 15*d*. Note that the control device 15*f* determines, for each of the toners of different colors, the light intensity of each of the laser irradiation sections 15*a* through 15*d*.

The control device 15*f* stores, in advance, the fixed output of the semiconductor laser element 1 of each of the laser irradiation sections 15*a* through 15*d*, so as to determine the light intensity of the laser beam emitted from each of the laser irradiation sections 15*a* through 15*d*. The control device 15*f* controls the laser irradiation sections 15*a* through 15*d* so that (i) the light intensity of the semiconductor laser element 1 of each of the laser irradiation sections 15*a* through 15*d* is not more than the fixed output, and (ii) the required energy amount En is equal to the total amount of the irradiation energy applied to the toner by the laser beams emitted from the laser irradiation sections 15*a* through 15*d*.

Here, a target toner has different absorbances and the like, with respect to the laser beams emitted from the respective laser irradiation sections 15*a* through 15*d*. Therefore, even if the laser irradiation sections 15*a* through 15*d* emit the laser beams which are identical with each other in light intensity, amounts of energy, applied to the target toner by the laser beams emitted from the respective laser irradiations sections 15*a* through 15*d*, are different from each other. For this reason, it is necessary to carry out a conversion process for finding the amount of the irradiation energy applied to the target toner by the laser beam emitted from each of the laser irradiation sections 15*a* through 15*d*.

A method of finding the light intensity of the laser beam emitted from each of the laser irradiation sections 15*a* through 15*d* is described below, which method includes the conversion process. The following example deals with Control Example Note that in the case of Control Example 2 or 3, the process is the same as with Control Example 1.

First, the control device 15*f* stores the following parameters in advance. Note that the following parameters are set in advance on the basis of a material of each toner, and a property (including a measurement result of the absorbance) of the laser beam emitted from each of the laser irradiation sections 15*a* through 15*d*.

Absorbance of the black toner with respect to the laser beam emitted from the laser irradiation section 15*a* for the black toner: η4

Conversion factor for finding the absorbance of the black toner with respect to the laser beam emitted from the laser irradiation section 15*b* for the yellow toner: K1

Conversion factor for finding the absorbance of the black toner with respect to the laser beam emitted from the laser irradiation section 15*c* for the magenta toner: K2

Conversion factor for working out the absorbance of the black toner with respect to the laser beam emitted from the laser irradiation section 15*d* for the cyan toner: K3

Then, the control device 15*f* uses the parameters with the following formulas so as to find: an absorbance Aky of the black toner with respect to the laser beam emitted from the laser irradiation section 15*b* for the yellow toner; an absorbance Akm of the black toner with respect to the laser beam emitted from the laser irradiation section 15*c* for the magenta toner; and an absorbance Akc of the black toner with respect to the laser beam emitted from the laser irradiation section 15*d* for the cyan toner.

$$Aky=K1\times n4$$

$$Akm=K2\times n4$$

$$Akc=K3\cdot n4$$

Here, not all of the energy of the laser beam exhibiting each of the absorbances Aky, Akm, and Akc is used to fuse the black toner. For example, some light is scattered by the black toner, and discharged to the outside again.

Therefore, the control device 15*f* stores, in advance, factors α1 through α4, each of which indicates a proportion of energy used to fuse the black toner among the energy of the absorbed laser beam. The control device 15*f* multiplies each of the absorbances Aky, Akm, Akc, and η4 by a corresponding factor among the factors α1 through α4, so as to find a percentage of the energy used to fuse the black toner. Such percentages Cky, Ckm, Ckc, and Ckk are found by use of the following formulas.

$$Cky=Aky\times\alpha 1$$

$$Ckm=Akm\times\alpha 2$$

$$Ckc=Akc\times\alpha 3$$

$$Ckk=\eta 4\times\alpha 4$$

The factor α1 indicates a proportion of light used to fuse the black toner among light that has not been transmitted through the black toner in a case where the laser irradiation section 15*b* for the yellow toner irradiates the black toner with the laser beam thereof. The factor α2 indicates a proportion of light used to fuse the black toner among light that has not been transmitted through the black toner in a case where the laser irradiation section 15*c* for the magenta toner irradiates the black toner with the laser beam thereof. The factor α3 indicates a proportion of light used to fuse the black toner among light that has not been transmitted through the black toner in a case where the laser irradiation section 15*d* for the cyan toner irradiates the black toner with the laser beam thereof. The factor α4 indicates a proportion of light used to fuse the black toner among light that has not been transmitted through the black toner in a case where the laser irradiation section 15*a* for the black toner irradiates the black toner with the laser beam thereof.

The factor α1 can be found in advance by measuring a change in temperature of the black toner when the black toner is irradiated with the laser beam emitted from the irradiation section 15*b* for the yellow toner, for example. That is, a total energy amount Ps of the laser beam emitted from the laser irradiation section 15*b* is found on the basis of the light intensity and an irradiation period of time, and a total energy amount Pu supplied to fuse the black toner is found on the basis of the change in temperature of the black toner and the amount of the black toner. The factor α1 can be found by dividing Pu by Ps×Aky. In the same manner, the factors α2, α3, and α4 can be found in advance.

Further, not all of the laser beams emitted from the respective laser irradiation sections 15*a* through 15*d* enter into the target irradiation sub spot.

Therefore, the control device 15*f* stores, in advance, factors β1 through β4, each of which is found by taking into consideration such a loss. The control device 15*f* multiplies each of the Cky, Ckm, Ckc, and Ckk by a corresponding factor among the factors β1 through β4, so as to find a percentage of the actually used irradiation energy. Such percentages Dky, Dkm, Dkc, and Dkk are found by use of the following formulas.

$$Dky=Cky\times\beta 1$$

$$Dkm=Ckm\times\beta 2$$

$$Dkc=Ckc\times\beta 3$$

$$Dkk=Ckk\times\beta 4$$

The factor β1 indicates a proportion of light that has entered into the target irradiation sub spot among the laser beam emitted from the semiconductor laser element 1 of the laser irradiation section 15*b* for the yellow toner. The factor β2 indicates a proportion of light that has entered into the target irradiation sub spot among the laser beam emitted from the semiconductor laser element 1 of the laser irradiation section 15*c* for the magenta toner. The factor β3 indicates a proportion of light that has entered into the target irradiation sub spot among the laser beam emitted from the semiconductor laser element 1 of the laser irradiation section 15*d* for the cyan toner. The factor β4 indicates a proportion of light that has entered into the target irradiation sub spot among the laser beam emitted from the semiconductor laser element 1 of the laser irradiation section 15*a* for the black toner.

Each of the factors β1 through β4 can be found in advance by measuring (i) the light intensity of the laser beam emitted from a single semiconductor laser element 1 of that laser irradiation section, and the light intensity of the laser beam that has entered into the irradiation sub spot in a case where that laser irradiation section irradiates the irradiation sub spot with their laser beam thereof.

The control device 15*f* sets, per irradiation sub spot, each of the light intensities Pa through Pd of the light emitted from the respective laser irradiation sections 15*a* through 15*d* so that the following Formula (a) is satisfied.

$$Pa\times Dkk\times t+Pb\times Dky\times t+Pc\times Dkm\times t+Pd\times Dkc\times t=En \qquad \text{Formula (a)}$$

Here, "t" is an irradiation period of time. The "t" is determined on the basis of the speed at which the sheet P is carried.

For example, in a case where an equality of "Pa×Dkk×t=En" is satisfied under a condition where the light intensity of the laser irradiation section 15*a* for the black toner is not more than the fixed output, the control device 15*f* sets the light intensity of the laser irradiation section 15*a* for the black toner to the Pa, and controls the other laser irradiation sections 15*b* through 15*d* not to emit their laser beams.

On the other hand, in a case where the light intensity of the laser irradiation section 15*a* for the black toner is set to a maximum fixed output Pamax, and an inequality of "Pamax×Dkk×t<En" is still satisfied, the control device 15*f* sets (i) the light intensity of the laser irradiation section 15*a* for the black toner to the fixed output Pamax, and (ii) the light intensities Pb, Pc, and Pd of the other three laser irradiation sections 15*b* through 15*d* so that the aforementioned Formula (a) is satisfied, while the laser irradiation sections 15*b* through 15*d* have the same irradiation energy. For example, in a case where the required energy amount is 100, the control device 15*f* (i) sets the light intensity of the laser irradiation section 15*a* for the black toner to the fixed output so that the laser irradiation section 15*a* supplies 55% of the total irradiation energy, and (ii) drives the other laser irradiation sections 15*b* through 15*d* so that each of the laser irradiation section 15*b* through 15*d* supplies 15% of the total irradiation energy. Thereby, the required energy amount is supplied.

Here, by dividing both sides of the inequality of "Pamax×Dkk×t<En" by "t", an inequality of "Pamax×Dkk<En/t" is obtained. The right side indicates an energy amount per unit of time. Therefore, in a case where "Pamax×Dkk×t<En" is satisfied, the energy amount per unit of time, required to fuse the target toner, is more than a predetermined threshold value (in this case, "Pamax×Dkk").

The inequality of "Pamax×Dkk×t<En" is satisfied in the case of the high-speed printing or in a case of printing in which the amount of the adhering toner is large. In such a case, the required irradiation energy cannot be satisfied with only the irradiation energy of a laser beam A (see FIG. 11) originally required for the black toner. Therefore, the black toner is also irradiated with laser beams B, C, and D for the other toners. The black toner absorbs each of the laser beams B, C, and D, and thereby the fusion of the black toner is accelerated. With this arrangement, even under a condition where the laser irradiation section for the black toner is originally required to have high power, it is possible to accelerate the fusion of the black toner by irradiating the black toner with additional laser beams emitted from the other laser irradiation sections. Thereby, it is possible to, without using a high-power laser irradiation section, (i) prevent an increase in cost, (ii) suppress the heat generation, (iii) carry out thermal dispersion, and (iv) make a contribution to realization of a compact device.

Note that it is possible to use the following Formula (a') in place of the above Formula (a).

$$En+C\geq Pa\times Dkk\times t+Pb\times Dky\times t+Pc\times Dkm\times t+Pd\times Dkc\times t\geq En \qquad \text{Formula (a')}$$

Here, "C" is determined in advance in such a range that an air bubble would not be generated inside the toner (i.e. the blister would not be generated).

The light intensities Pa, Pb, Pc, and Pd are set in such as range that the above Formula (a') is satisfied. By using the Formula (a'), it is possible to appropriately control the laser irradiation sections 15*a* through 15*d* even if the laser irradiation sections 15*a* through 15*d* can have only discrete values of light intensity.

As described above, the Formula (a) includes the irradiation period of time "t". In a case where there is an image made of only the black toner in the low-speed printing, such as the color printing, it is possible to satisfy the Formula (a) by use of the laser irradiation section 15*a* for the black toner only. However, in the high-speed printing, such as the black-and-white printing, there may be a case where the Formula (a) cannot be satisfied by the laser irradiation section 15*a* for the black toner only. Therefore, it is possible to control the four laser irradiation sections 15*a* through 15*d* to irradiate the black toner with the laser beams thereof only in the case of the high-speed printing (Control Example 1).

In other words, in the case of the single color printing, e.g. the black-and-white printing (here, 70 sheets/minute, high-speed single color printing), the irradiation energy required to fuse the toner per unit of time becomes large as compared with the color printing. In this case, the single laser irradiation section 15*a* cannot supply the heat required to fuse the toner sufficiently, so that the fixing strength becomes poor. Therefore, according to the present embodiment, in order to provide the irradiation energy necessary to fuse the toner, the other laser irradiation sections 15*b* through 15*d* are driven, as sub irradiation sections, to secure the necessary irradiation energy, instead of increasing the fixed output of the laser irradiation section 15*a*. That is, it is unnecessary to increase the fixed output of each of the laser irradiation sections 15*a* through 15*d*. Therefore, it is possible to sufficiently fuse the toner without an increase in size of each of the laser irradiation sections 15*a* through 15*d*.

MODIFIED EXAMPLE

The present invention is not limited to the aforementioned embodiment, and can be modified in various ways. The following description deals with a modified example of the present invention.

In the above descriptions, the laser irradiation sections 15*a* through 15*d* are arranged such that a light path of a laser beam emitted from each of the laser irradiation sections 15*a* through 15*d* is oblique to a direction of a normal line with respect to a sheet P. Such an arrangement allows the laser beams emitted from the respective laser irradiation sections 15*a* through 15*d* to overlap each other at an irradiation spot on the sheet P. Therefore, it is possible to simultaneously irradiate the irradiation spot with the laser beams from the respective plurality of laser irradiation sections 15*a* through 15*d*. Note, however, that the present invention is not limited to this.

Figure 12:
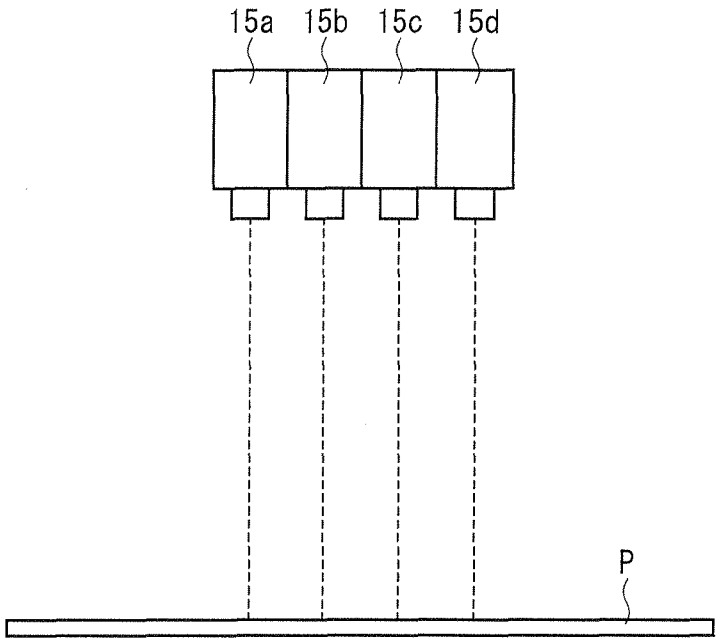
FIG. 12 is a view illustrating a modified example of a layout of the laser irradiation sections.

For example, the laser irradiation sections 15*a* through 15*d* may be arranged with narrower intervals therebetween, and emit their laser beams along the direction of the normal line with respect to the sheet P (see FIG. 12). In this case, the laser irradiation sections 15*a* through 15*d* irradiate an irradiation spot with their laser beams with certain time intervals. For this reason, it becomes necessary to set an output of each of the laser irradiation sections 15*a* through 15*d* to be higher than that of the aforementioned embodiment. However, it becomes easy to arrange the laser irradiation sections 15*a* through 15*d*.

Figure 13:
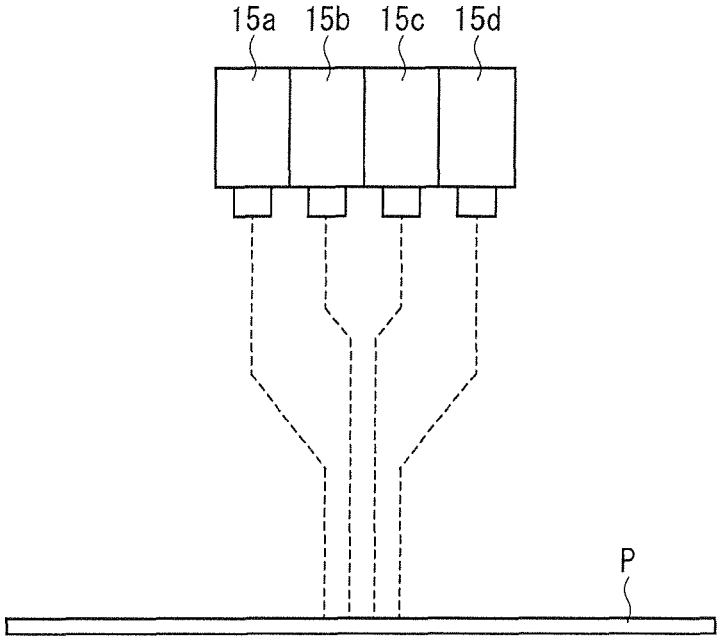
FIG. 13 is a view illustrating another modified example of the layout of the laser irradiation sections.

Alternatively, it is also possible that (i) the laser irradiation sections 15*a* through 15*d* emit their laser beams along the direction of the normal line with respect to the sheet P, and (ii) the light path of the laser beam from each of the laser irradiation sections 15*a* through 15*d* is adjusted by an optical member, such as a mirror, so that at least a part of the laser beam emitted from each of the laser irradiation sections 15*a* through 15*d* overlaps another laser beam emitted from one of the other laser irradiation sections with each other (see FIG. 13). This can fuse the toner by simultaneously irradiating the toner with the laser beams emitted from a plurality of laser irradiation sections among the laser irradiation sections 15*a* through 15*d*, and suppress the output of each of the laser irradiation sections 15*a* through 15*d*.

Further, in the above descriptions, each of the laser irradiation section 15*a* through 15*d* is such that a plurality of semiconductor laser elements 1 are arrayed along a width direction of the sheet P. However, it is possible to employ a laser irradiation section having a scan optical system. As compared with the laser irradiation sections 15*a* through 15*d* each being such a laser array that the plurality of semiconductor laser elements 1 are arrayed, the laser irradiation section having the scan optical system can have a reduction in the number of the semiconductor laser elements, although each of the semiconductor laser elements is required to have a rotation mechanism and a larger fixed output. This makes it easier to control the laser irradiation section.

Figure 14:
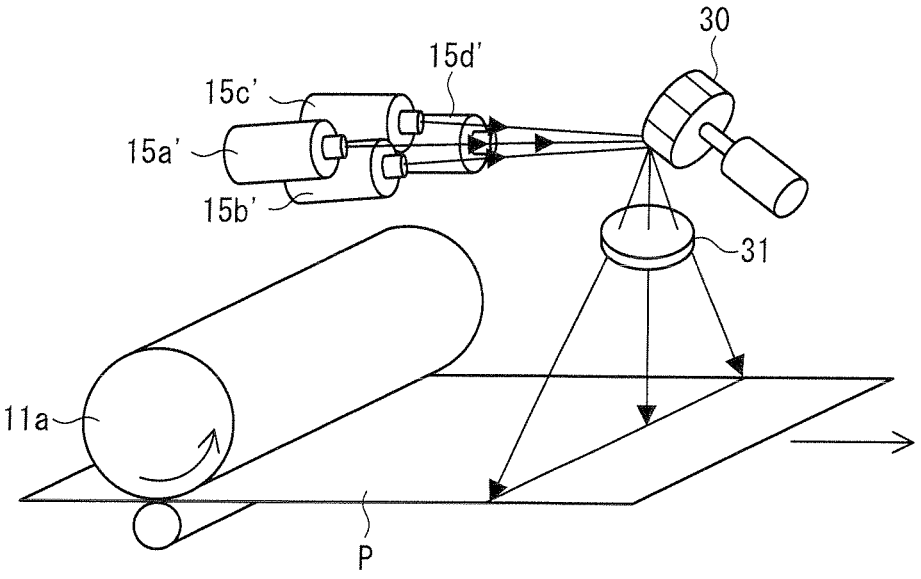
FIG. 14 is a view illustrating a laser irradiation section employing a scanning optical system.

FIG. 14 is a view illustrating a configuration of the laser irradiation section having the scan optical system. The laser irradiation section includes: a laser beam source 15*a*' for emitting a laser beam for a black toner; a laser beam source 15*b*' for emitting a laser beam for a yellow toner; a laser beam source 15*c*' for emitting a laser beam for a magenta toner; a laser beam source 15*d*' for emitting a laser beam for a cyan toner; a multifaceted mirror (polygon mirror) for leading the laser beams emitted from the respective laser beam sources 15*a*' through 15*d*' to be along the width direction of the sheet P; and a compensation lens (scan optical member) (e.g. an fθ lens or a condensing lens) 31 for compensating an aberration generated by polarization of the laser beams and condensing the laser beams on the sheet P (see FIG. 14). According to this arrangement, it is possible to scan the sheet P with the laser beams in the width direction of the sheet P by rotating the polygon mirror 30. Further, it becomes possible to irradiate an entire surface of the sheet P with the laser beams by carrying the sheet P in a direction vertical to the width direction of the sheet P.

Note that instead of employing the polygon mirror (scan optical member) 30 illustrated in FIG. 14, it is possible to employ a galvanometer mirror which is a single mirror oscillated around a center axis (oscillated from side to side by a predetermined angle).

With the laser irradiation section illustrated in FIG. 14, the control device 15*f* operates in the same manner as the aforementioned embodiment.

For example, in the case of the black-and-white printing, the control device 15*f* adjusts light intensities of the laser beam sources 15*a*' through 15*d*' so that for a required energy amount En required to fuse the black toner, the laser beam source 15*a*' for the black toner supplies 50% of required energy, the laser beam source 15*d*' for the cyan toner subsidiarily supplies 15% of the required energy, the laser beam source 15*c*' for the magenta toner subsidiarily supplies 25% of the energy, and the laser beam source 15*b*' for the yellow toner subsidiarily supplies 10% of the required energy.

In a case where the fixing is carried out by the laser irradiation, it is possible to selectively heat the toner. Therefore, image information of input image data is analyzed per color, and the output of each of the laser beam sources 15*a*' through 15*d*' is determined per irradiation sub spot. On the basis of the determined outputs, each of the irradiation sub spots is irradiated with one, two, three, or four laser beams appropriately. This can suppress heat generation due to continuous driving for a long period of time, and contribute to energy saving by suppressing unnecessary irradiation.

Each of the laser beam sources 15*a*' through 15*d*' of the laser irradiation section illustrated in FIG. 14 has a relatively large fixed output. Thereby, the amount of generated heat becomes large. For this reason, it is desirable to use a cooling device having higher cooling performance without an increase in size of the cooling device. Further, even with the laser irradiation sections 15*a* through 15*d* illustrated in FIG.

2, it is assumed that an image forming apparatus 100 having a further compact body will be demanded increasingly.

In order to allow the image forming apparatus 100 to have stable cooling performance without an increase in size of the cooling device, the heat generated by the laser irradiation section is temporarily transferred to another area (cooling section), and then is cooled by an air-cooling system in the area. This allows a more flexible layout of the laser irradiation section. That is, it becomes possible to arrange the laser irradiation section in such a position that the laser irradiation section can carry out more efficient laser irradiation, or in such a position that the laser irradiation section can have a reduction in its size.

Note, however, that other components, such as image forming section and a power source circuit, are provided between the laser irradiation section and an actual cooling section. Further, in consideration of a cooling effect and a position of a duct, which position is determined to easily discharge the heat to the outside, it is highly possible that still other components should be provided between the laser irradiation section and the cooling section. Generally, such an arrangement causes a discharging property to be relatively poor, so that a temperature in the image forming apparatus tends to be high. Alternatively, such an arrangement employs a thin cooling fan which cannot discharge a large amount of heat, so that the cooling effect becomes poor. Such a poor cooling effect or an increase in temperature inside the image forming apparatus has a significant influence on the image forming section which is easily influenced by a change in temperature.

In view of the problems, the cooling may be carried out in such a manner that (i) the heat generated by the laser irradiation sections (laser beam sources), which are sources of the heat generation, is transferred to another area via a meandering narrow tube heat pipe, and then (ii) the heat is dissipated there into the atmosphere by the air cooling system. Here, the air cooling system may be replaced with a water cooling system or an electron cooling system, such as a Peltier device.

Figure 16:
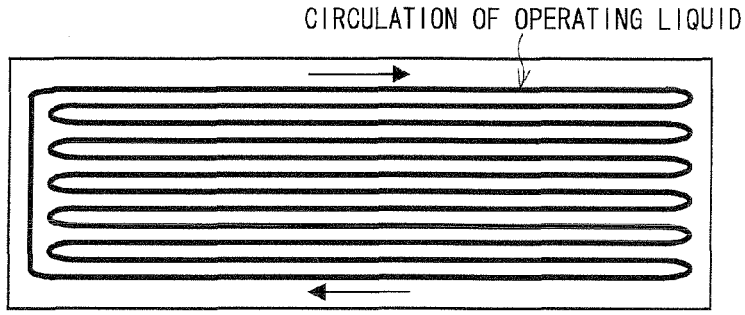
FIG. 16 is a view illustrating movement of an operating liquid in the meandering narrow tube heat sink.

The meandering narrow tube heat pipe is a well-known technique described on the following web page, for example: http://www.tsheatronics.co.jp/technology/index.htm 1. As illustrated in FIG. 16, the heat pipe is a heat transfer device which has a loop (endless) meandering narrow tube whose diameter is smaller than that of a conventional heat pipe, and accelerates the cooling effect by circulating an operating liquid in the narrow tube. A container of the meandering marrow tube may be made of a metal plate (e.g. aluminum, copper, stainless, steel, titanium etc.). Further, the operating liquid may be water or another medium. The heat pipe has an advantage of high flexibility in design. In a case where the meandering narrow tube heat pipe is used, the heat pipe can be bended arbitrarily. Further, the meandering narrow tube heat pipe can transfer more heat than a conventional heat pipe, and can stably transfer the heat even in a direction in which the heat cannot be easily transferred. Particularly, the meandering narrow tube heat pipe enables the heat to be transferred from a high position to a low position. Such a transfer has been conventionally difficult. Therefore, the meandering narrow tube heat pipe is suitably used to transfer the heat generated by the laser irradiation sections (laser beam sources) to the cooling section without interfering the other components.

Figure 15:
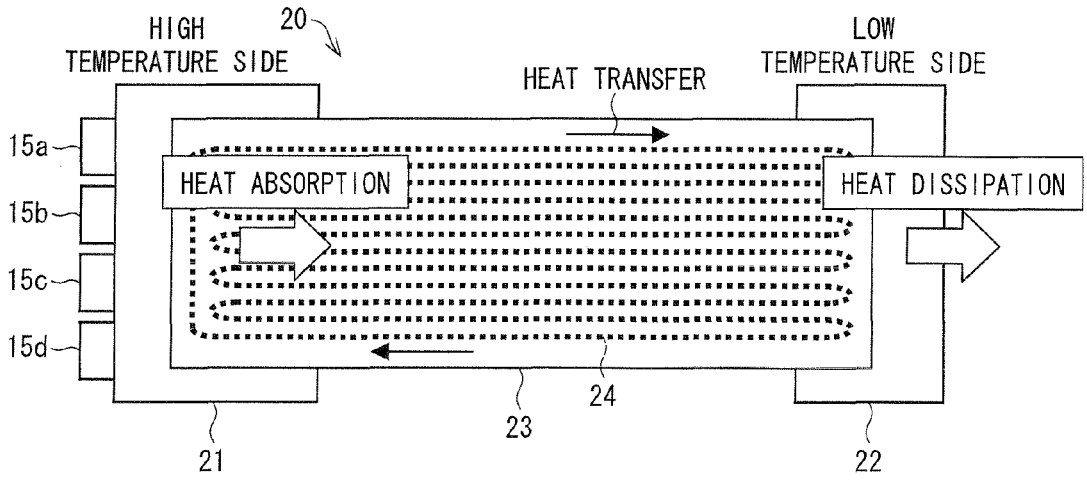
FIG. 15 is a view illustrating an example in a case where a meandering narrow tube heat sink is applied to the fixing device.

FIG. 15 is a view illustrating an embodiment in which the meandering narrow tube heat pipe is used. A cooling device 20 includes: a metal plate 21, having a high heat transfer property, to which the laser irradiation sections 15*a* through 15*d* (or the laser beam sources 15*a*' through 15*d*') are attached; a heat radiator 22 positioned at a heat dissipation part of the image forming apparatus; and a heat transfer member 23 being in contact with both the metal plate 21 and the heat radiator 22, which heat transfer member 23 includes a meandering narrow tube heat pipe 24 (see FIG. 15). With the arrangement, the meandering narrow tube heat pipe (i) absorbs the heat generated by the laser irradiation sections 15*a* through 15*d* (or the laser beam sources 15*a*' through 15*d*') via the metal plate 21, (ii) transfers the absorbed heat to the heat radiator 22, and (iii) dissipates the heat by the heat radiator 22.

Thereby, it becomes possible to (i) efficiently transfer the heat generated by the laser irradiation sections 15*a* through 15*d* (or the laser beam sources 15*a*' through 15*d*') to the heat radiator provided in such a position that the cooling can be carried out effectively, and (ii) dissipate the heat there. Further, the laser irradiation sections 15*a* through 15*d* (or the laser beam sources 15*a*' through 15*d*') can be cooled without being influenced by an internal arrangement or an internal layout of the image forming apparatus. Therefore, a limitation in layout of the cooling device can be significantly improved.

Further, in the above descriptions, the four laser irradiation sections 15*a* through 15*d* (or the laser beam sources 15*a*' through 15*d*') are used. However, the present invention is not limited to this. For example, one laser irradiation section can be shared by the magenta toner and the cyan toner. In this case, three laser irradiation sections are used.

As described above, a fixing device (laser fixing device) 15 of the present embodiment, for use in an electrophotographic image forming apparatus 100 which forms an image on a sheet P by use of a plurality of toners of different colors (K, Y, M, C), fixes, on the sheet P, a toner adhering to the sheet P among the plurality of toners by fusing the toner. The fixing device irradiates the toner with laser beams so as to fuse the toner.

The fixing device 15 includes a plurality of laser irradiation sections 15*a* through 15*d* which emit laser beams whose wavelengths are different from each other, respectively. Each of the toners of different colors (K, Y, M, C) corresponds to one of the laser irradiation sections 15*a* through 15*d*. Here, the laser irradiation sections 15*a* through 15*d* output laser beams, respectively, which laser beams correspond to the K toner, the Y toner, the M toner, and the C toner, respectively. Each of the laser beams has a wavelength to which a corresponding toner has an absorbance of 80% or more. Further, the fixing device 15 includes a control device 15*f* which controls the laser irradiation sections 15*a* through 15*d* so that in order to fuse at least one of the toners (e.g. the black toner), the laser irradiation section 15*a* corresponding to that toner irradiates that toner with the laser beam thereof, and at least one of the other laser irradiation sections 15*b* through 15*d* also irradiates that toner with the laser beams thereof.

This can balance the electric power for driving the laser irradiation sections 15*a* through 15*d*, as compared with a case where a target toner is irradiated with only a laser beam emitted from a corresponding laser irradiation section among the laser irradiation sections 15*a* through 15*d*. Accordingly, it is possible to (i) disperse the heat generated by the laser irradiation sections 15*a* through 15*d*, and therefore (ii) have a reduction in size of a heat sink 9. Furthermore, the energy used to fuse the target toner is supplied by the laser irradiation sections 15*a* through 15*d*. Therefore, it becomes unnecessary to cause a fixed output of each of the laser irradiation sections 15*a* through 15*d* to be high. Accordingly, it is possible to realize highly efficient laser irradiation without an increase in cost and an increase in size of the fixing device. Moreover, it is possible to prevent deterioration of the laser irradiation sections 15*a* through 15*d* due to the heat, and extend a life of each of the laser irradiation sections 15*a* through 15*d*.

For example, according to Control Example 1, in a case where a black-and-white image (single color image) is formed by use of the black toner, the control device 15*f* controls the laser irradiation sections 15*a* through 15*d* to irradiate the black toner with their laser beams so as to fuse the black toner.

Further, in a case where the laser irradiation section 15*a* can function as a specific laser irradiation section for outputting a laser beam exhibiting an absorbance equal to or more than a predetermined value (e.g. 70%) with respect to not only the black toner but also the other toners (Y, M, C), it is possible to carry out the control in accordance with Control Example 2. In this case, the control device 15*f* controls the laser irradiation sections 15*a* through 15*d* so that in order to fuse not the black toner but a non-specific toner (Y, M, C), a laser irradiation section corresponding to that toner irradiates the non-specific toner with the laser beam thereof, and the laser irradiation section 15*a* also irradiates the non-specific toner with the laser beam thereof.

In other words, Control Example 2 can be explained as described below. The laser irradiation section 15*a*, which does not correspond to any one of the toners (Y, M, C), to each of which an infrared absorbing material is added, is an infrared ray laser irradiation section for outputting a laser beam having a wavelength in an infrared ray region. The control device 15*f* controls the laser irradiation sections 15*a* through 15*d* so that in order to fuse each of the toners (Y, M, C), to each of which the infrared absorbing material is added, the laser irradiation section corresponding to that toner (Y, M, C), among the laser irradiation sections 15*b* through 15*d*, irradiates that toner with the laser beam thereof, and the laser irradiation section 15*a* also irradiates that toner with the laser beam thereof.

As described above, a laser fixing device of the present invention, for use in an electrophotographic image forming apparatus for forming an image on a sheet by use of a plurality of toners of different colors, the laser fixing device fusing a toner adhering to the sheet among the plurality of toners by irradiating the toner with a laser beam so as to fix the toner on the sheet, includes: a plurality of laser irradiation sections for outputting laser beams of different wavelengths, respectively, wherein each of the plurality of toners corresponds to one of the plurality of laser irradiation sections, and each of the plurality of laser irradiation sections outputs a laser beam whose wavelength exhibits an absorbance of 80% or more with respect to a corresponding one of the plurality of toners; and a control section for controlling the plurality of laser irradiation sections so that in order to fuse at least one of the plurality of toners, (i) a laser irradiation section, corresponding to the at least one of the plurality of toners among the plurality of laser irradiation sections, irradiates the at least one of the plurality of toners with a laser beam thereof, and (ii) at least one of the other laser irradiation sections among the plurality of laser irradiation sections also irradiates the at least one of the plurality of toners with a laser beam thereof.

Note that the control section does not always need to carry out the above irradiation control. The control section may carry out the above irradiation control only in a case where a specific condition is satisfied (e.g. in a case of high-speed black-and-white printing).

According to the arrangement, each of the plurality of irradiation sections can output a laser beams whose wavelength exhibits an absorbance of 80% or more with respect to a corresponding toner, so as to supply the corresponding toner with energy. The toner absorbs the energy of light emitted from the irradiation section. This increases a temperature of the toner, so that the toner is fused.

The toner has not only a wavelength band for absorbing the wavelength of the laser beam emitted from the corresponding laser irradiation section but also other wavelength bands for absorbing other wavelengths of other laser beams. That is, the toner has an absorbance, to some extent, with respect to each of the laser beams emitted from the other laser irradiation sections.

Therefore, according to the arrangement, the control section controls the plurality of irradiation sections so that in order to fuse at least one of the plurality of toners, (i) the laser irradiation section corresponding to that toner irradiates that toner with the laser beam thereof, and (ii) at least one of the other laser irradiation sections, which does not correspond to that toner, also irradiates that toner with the laser beam thereof. That is, not only the laser irradiation section corresponding to the toner but also another irradiation section(s) can subsidiarily irradiate the toner with the laser beam(s) thereof, so as to supply the toner with the energy by a plurality of laser beams.

Accordingly, as compared with a case where the toner is irradiated with only the laser beam emitted from the laser irradiation section corresponding to the toner, it becomes possible to (i) balance the electric power for driving the laser irradiation sections, and therefore (ii) have a reduction in size of cooling means by dispersing heat generated by the laser irradiation sections. Further, the energy required to fuse the toner is supplied by the plurality of laser irradiation sections, so that is unnecessary to adopt a laser irradiation section having a high fixed output, as each of the laser irradiation sections. Thereby, it is possible to realize highly efficient laser irradiation while preventing an increase in cost and an increase in size of the fixing device. Furthermore, it is also possible to prevent deterioration of the laser irradiation sections due to the heat, and therefore extend a life of each of the laser irradiation sections. As described above, according to the present invention, it is possible to provide a laser fixing device which can fix a color toner while preventing an increase in size of the laser fixing device as much as possible.

Further, in the present invention, in a case where a single color image is formed by use of only one of the plurality of toners, the control section preferably carries out said controlling so as to fuse the only one of the plurality of toners.

Here, the single color image is a black-and-white image made of the black toner only, for example. In a case where such a single color image is irradiated with the laser beam emitted from only the laser irradiation section corresponding to the toner, it is necessary to increase the fixed output of the laser irradiation section. This causes an increase in size of the laser irradiation section. According to the arrangement, however, in the case where the single color image is formed, the control section carries out the controlling so as to fuse the toner forming the single color image.

Accordingly, as compared with the case where the toner is irradiated with only the laser beam emitted from the laser irradiation section corresponding to the toner, it becomes possible to (i) balance the electric power for driving the laser irradiation sections, and therefore (ii) have a reduction in size of cooling means by dispersing heat generated by the laser irradiation sections. Further, the energy required to fuse the toner is supplied by the plurality of laser irradiation sections, so that it is unnecessary to adopt a laser irradiation section having a high fixed output, as each of the laser irradiation sections. Thereby, it is possible to realize highly efficient laser irradiation while preventing an increase in cost and an increase in size of the fixing device.

Further, in the present invention, one of the plurality of laser irradiation sections is preferably a specific laser irradiation section that is the at least one of the other laser irradiation sections and outputs a laser beam exhibiting an absorbance of not less than a predetermined value with respect to not only a toner corresponding to the specific laser irradiation section but also the other toners among the plurality of toners, and the control section preferably controls, as said controlling, the plurality of laser irradiation sections so that in order to fuse each of non-specific toners, (i) a laser irradiation section corresponding to that non-specific toner irradiates that non-specific toner with a laser beam thereof, and (ii) the specific laser irradiation section also irradiates that non-specific toner with the laser beam thereof, where the non-specific toners are toners other than the toner corresponding to the specific laser irradiation section, among the plurality of toners.

Some toner has an absorbance with respect to not only a corresponding single laser beam but also, to some extent, a plurality of laser beams having various wavelengths. Irradiation with not only a single laser beam but also a plurality of laser beams can sufficiently fuse such a toner.

Therefore, according to the arrangement, the control section preferably controls the plurality of laser irradiation sections so that in order to fuse each of the non-specific toners, (i) the laser irradiation section corresponding to that non-specific toner irradiates that non-specific toner with the laser beam thereof, and (ii) the specific laser irradiation section also irradiates that non-specific toner with the laser beam thereof. Accordingly, it is possible to irradiate the non-specific toner with laser beams emitted from a plurality of laser irradiation sections, and therefore fix the non-specific toner. As a result, it is possible to set the fixed output of the laser irradiation section corresponding to the non-specific toner to be lower, i.e. it is possible to suppress the electric power required by the laser irradiation section. Thereby, it is possible to suppress the heat generation, and extend a life of the laser irradiation section.

Furthermore, in the present invention, in a case where an amount of energy per unit time, required to fuse a target toner, among the plurality of toners, is more than a predetermined threshold value, the control section preferably carries out said controlling, where the target toner is a toner to fuse, where the target toner is a toner to fuse.

In a case of an image forming apparatus in which a speed at which the sheet is carried can be changed, an amount of energy per unit of time, required to fuse the target toner, varies in accordance with the speed at which the sheet is carried. That is, in the case of the high-speed printing, the amount of energy per unit of time becomes large. Further, in a case where an amount of the adhering toner is large, the amount of energy per unit of time also becomes large.

There has been known a technique for carrying out the color printing at a low speed, and the black-and-white printing at a high speed, for example. In this case, the laser irradiation section corresponding to the black toner is required to have a large fixed output so as to carry out the high-speed black-and-white printing.

According to the arrangement, however, in the case of the high-speed black-and-white printing, the control section controls the laser irradiation sections so that in order to fuse the black toner, (i) the laser irradiation section corresponding to the black toner irradiates the black toner with the laser beam thereof, and (ii) the laser irradiation sections corresponding to the other toners also radiate the black toner with the laser beams thereof. That is, the laser irradiation sections corresponding to the other toners subsidiarily irradiate the black toner with the laser beams thereof.

This makes it unnecessary to cause the fixed output of the laser irradiation section corresponding to the black toner to be higher. Therefore, it is possible to prevent an increase in cost and an increase in size of the fixing device.

Moreover, in the present invention, in a case where the control section carries out said controlling, the control section preferably sets light intensity of each of the laser beams emitted from corresponding ones of the plurality of laser irradiation sections to a target toner, among the plurality of toners, so that a total amount of energy of the laser beams, absorbed by the target toner, is not less than an amount of energy, required to fuse the target toner, where the target toner is a toner to fuse.

According to the arrangement, each of the other laser irradiation sections supply the energy in a range that does not exceed the fixed output of that laser irradiation section, so that the required amount, which cannot be satisfied by the single laser irradiation section, can be satisfied. Thereby, the toner can be sufficiently fused. Therefore, it is possible to have a reduction in cost, without using a laser irradiation section having a high fixed output. Further, additionally, the source of heat generation can be dispersed. This makes it possible to prevent harmful effects, such as deterioration and/or a break-up of the laser irradiation and a reduction in output of the laser irradiation section.

Note that the target toner is the black toner, for example.

Further, in the present invention, each of the plurality of laser irradiation sections is preferably constituted by a laser array in which a plurality of semiconductor laser elements are arrayed in a direction orthogonal to a direction in which the sheet is carried.

The semiconductor laser element has advantages of a compact body and a property of generating a small amount of heat, as compared with a conventional laser element having a large or middle output, such as a gas laser. Further, the semiconductor laser element can have high productivity by automated production, and has relatively high mass productivity.

The laser array in which a plurality of semiconductor laser elements are arrayed can irradiate, in the width direction of the sheet, the sheet with a plurality of laser beams simultaneously, and can easily deal with the high-speed printing. Further, In accordance with an entire laser array, the cooling means can be designed appropriately. For example, it is possible to design compact cooling means having a large output.

Furthermore, in the present invention, each of the plurality of laser irradiation sections preferable includes a laser light source for emitting the laser beam having said wavelength with respect to the corresponding one of the plurality of toners, and the laser fixing device preferably further includes a scanning optical member for scanning the sheet with the laser beam in a direction orthogonal to a direction in which the sheet is carried.

According to arrangement, it is possible to reduce the number of laser beam sources, which are to be sources of heat generation. Therefore, it is possible to reduce the number of components by reducing the number of cooling means.

Moreover, in the present invention, the laser fixing device preferably further includes a meandering narrow tube heat pipe for dissipating heat generated by the laser irradiation sections, the meandering narrow tube heat pipe being attached to the plurality of laser irradiation sections.

A conventional heat sink has a relatively large size. For this reason, it has been difficult to apply the heat sink to a compact image forming apparatus.

According to the arrangement, however, the laser fixing device includes the meandering narrow tube heat pipe. The meandering narrow tube heat pipe can be bent so as to transfer the heat generated by the laser irradiation sections (sources of the heat generation) to another area. Thereby, it is possible to carry out laser irradiation stably by a cooling effect of an air cooling system without a blower, or an air cooling system with a blower. Particularly, the meandering narrow tube heat pipe can transfer the heat in any directions, e.g. an up-and-down direction or a right-and-left direction. For this reason, it becomes possible to significantly improve a limitation in layout of the heat sink. Further, it is possible to realize high flexibility in arranging the other components in the image forming apparatus.

Further, in the present invention, the plurality of laser irradiation sections preferably output the laser beams thereof toward areas on the sheet, respectively, which areas preferably overlap each other.

According to the arrangement, the plurality of laser irradiation sections irradiate the toner with the laser beams thereof with no time interval. Therefore, it is possible to accelerate the fusion of the toner. For example, even if the laser irradiation section slightly misses the irradiation area due to a multilayer structure of the toners, it is possible for the irradiation sections to fuse the target toner by irradiating the target toner with the laser beams thereof. This makes it possible to improve the heating efficiency as an entire fixing device, and allows the fixing device to deal with the high-speed printing.

Furthermore, in the present invention, each of the plurality of laser irradiation sections preferably outputs the laser beam thereof in a direction oblique to a direction of a normal line with respect to the sheet.

In the case of the color printing, a plurality of toners are provided as layers overlapping each other. Therefore, in a case where the laser beam is emitted along the direction of the normal direction with respect to the sheet, the toner provided as a lower layer cannot receive the laser beam and cannot be heated sufficiently. In this case, it is necessary to heat the toner provided as the lower toner by increasing the output of the laser irradiation section.

According to the arrangement, however, each of the irradiation sections irradiates the sheet with the laser beam at a corresponding incident angle. This allows irradiation of the laser beam to the lower toner even in a case where a plurality of toners are provided as layers overlapping each other. As a result, it is unnecessary to increase the output of the laser irradiation section. Consequently, it is possible to efficiently heat the toners even at a low output. Further, since it is unnecessary to increase the output of the laser irradiation section, it is also possible to extend a life of the laser irradiation section.

Moreover, in the laser fixing device of the present invention, at least one of the plurality of toners is preferably an infrared absorbing toner to which an infrared absorbing material is added, among the plurality of laser irradiation sections, one laser irradiation section which does not correspond to the infrared absorbing toner is preferably an infrared laser irradiation section for outputting a laser beam having a wavelength in an infrared range, and the control section preferably controls the plurality of laser irradiation sections so that (i) a laser irradiation section corresponding to the infrared absorbing toner irradiates the infrared absorbing toner with a laser beam thereof, and (ii) the infrared laser irradiation section also irradiates the infrared absorbing toner with the laser beam thereof.

In a case where the infrared absorbing material is added to a toner, the toner absorbs the infrared ray contained in the laser beam. That is, the toner receives more irradiation energy. Therefore, the fusion of the toner is accelerated. However. If the infrared absorbing material is added to a color toner excessively, development of a color material of the color toner is generally inhibited. This causes a decrease in brightness of the color.

According to the arrangement, however, the control section controls the laser irradiation section corresponding to the target toner and the infrared laser irradiation section to irradiate the target toner with their laser beams. That is, the target toner is irradiated with not only the laser beam (infrared laser beam) emitted from the infrared laser irradiation section, but also the laser beam having a wavelength corresponding to the color of the target toner. Therefore, as compared with the case where the toner is fused with only the laser beam (infrared laser beam) emitted from the infrared laser irradiation section, it becomes possible to suppress an amount of the added infrared absorbing material. This prevents a decrease in brightness of the color.

Further, an image forming apparatus of the present invention includes the above laser fixing device. Therefore, it is possible to realize an image forming apparatus which can fix a toner by irradiating the toner with a laser beam, and has excellent energy saving performance with no need to unnecessarily heat a sheet.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is applicable to an electrophotographic image forming apparatus. Examples of the electrophotographic image forming apparatus encompass: a printer; a copying machine; a multifunctional apparatus; and a facsimile apparatus.

REFERENCE SIGNS LIST

1: Semiconductor laser element
9: Heat sink
15: Fixing device (laser fixing device)
15*a* through 15*d*: Laser irradiation section
15*a*' through 15*d*': Laser beam source
15*f*: Control device (control section)
20: Cooling device
23: Heat transfer member
24: Meandering narrow tube heat pipe
30: Polygon mirror (scanning optical member)
31: Correction lens (scanning optical member)
100: Image forming apparatus
P: Sheet

The invention claimed is:

1. A laser fixing device for use in an electrophotographic image forming apparatus for forming an image on a sheet by use of a plurality of toners of different colors, the laser fixing device fusing a toner adhering to the sheet among the plurality of toners by irradiating the toner with a laser beam so as to fix the toner on the sheet, the laser fixing device comprising:

a plurality of laser irradiation sections for outputting laser beams of different wavelengths, respectively, wherein each of the plurality of toners corresponds to one of the plurality of laser irradiation sections, and each of the plurality of laser irradiation sections outputs a laser beam whose wavelength exhibits an absorbance of 80% or more with respect to a corresponding one of the plurality of toners; and a control section for carrying out irradiation control in which the plurality of laser irradiation sections are controlled so that in order to fuse a target toner which is at least one of the plurality of toners, (i) a laser irradiation section, corresponding to the target toner among the plurality of laser irradiation sections, irradiates the target toner with a laser beam thereof, and simultaneously (ii) at least one of the other laser irradiation sections among the plurality of laser irradiation sections also irradiates the target toner with a laser beam thereof;

wherein the control section carries out the irradiation control also in a region including only the target toner;

wherein each of the plurality of laser irradiation sections emits a laser beam on a sheet in a direction oblique to the normal line of the sheet;

the plurality of laser irradiation sections are provided independently;

wherein the plurality of laser irradiation sections comprise a first toner laser irradiation section, a second toner laser irradiation section, a third toner laser irradiation section, and a fourth toner laser irradiation section;

wherein a first toner is black toner and the first toner laser irradiation section is a black toner laser irradiation section;

wherein when a black-and-white image is to be formed the control section carries out the irradiation control by simultaneously using the black toner laser irradiation section, the second toner laser irradiation section, the third toner laser irradiation section, and the fourth toner laser irradiation section; and where when one of a second toner, a third toner, and a fourth toner is to be irradiated, the control section carries out the irradiation control by simultaneous using the black toner laser irradiation section in addition to a respective one of the second toner laser irradiation section, the third toner laser irradiation section, and fourth toner laser irradiation section.

2. The laser fixing device as set forth in claim 1, wherein:

in a case where an amount of energy per unit time, required to fuse a target toner, among the plurality of toners, is more than a predetermined threshold value, the control section carries out said controlling, where the target toner is a toner to fuse.

3. The laser fixing device as set forth in claim 1, wherein:

in a case where the control section carries out said controlling, the control section sets light intensity of each of the laser beams emitted from corresponding ones of the plurality of laser irradiation sections to a target toner, among the plurality of toners, so that a total amount of energy of the laser beams, absorbed by the target toner, is not less than an amount of energy, required to fuse the target toner, where the target toner is a toner to fuse.

4. The laser fixing device as set forth in claim 1, wherein:

each of the plurality of laser irradiation sections is constituted by a laser array in which a plurality of semiconductor laser elements are arrayed in a direction orthogonal to a direction in which the sheet is carried.

5. The laser fixing device as set forth in claim 1, wherein:

each of the plurality of laser irradiation sections includes a laser light source for emitting the laser beam having said wavelength with respect to the corresponding one of the plurality of toners; and the laser fixing device further comprises a scanning optical member for scanning the sheet with the laser beam in a direction orthogonal to a direction in which the sheet is carried.

6. The laser fixing device as set forth in claim 1, further comprising:

a meandering narrow tube heat pipe for dissipating heat generated by the laser irradiation sections, the meandering narrow tube heat pipe being attached to the plurality of laser irradiation sections.

7. The laser fixing device as set forth in claim 1, wherein:

the plurality of laser irradiation sections output the laser beams thereof toward areas on the sheet, respectively, which areas overlap each other.

8. The laser fixing device as set forth in claim 1, wherein:

each of the plurality of laser irradiation sections outputs the laser beam thereof in a direction oblique to a direction of a normal line with respect to the sheet.

9. The laser fixing device as set forth in claim 1, wherein:

at least one of the plurality of toners is an infrared absorbing toner to which an infrared absorbing material is added;

among the plurality of laser irradiation sections, one laser irradiation section which does not correspond to the infrared absorbing toner is an infrared laser irradiation section for outputting a laser beam having a wavelength in an infrared range; and the control section controls the plurality of laser irradiation sections so that (i) a laser irradiation section corresponding to the infrared absorbing toner irradiates the infrared absorbing toner with a laser beam thereof, and (ii) the infrared laser irradiation section also irradiates the infrared absorbing toner with the laser beam thereof.

10. An electrophotographic image forming apparatus comprising:

a laser fixing device as set forth in claim 1.

11. The laser fixing device as set forth in claim 1, wherein the second toner is yellow toner and the second toner laser irradiation section is a yellow toner laser irradiation section;

wherein the third toner is magenta toner and the third toner laser irradiation section is a magenta toner laser irradiation section; and, wherein the fourth toner is cyan toner and the fourth toner laser irradiation section is a cyan toner laser irradiation section.

* * * * *